US009920464B2

(12) United States Patent
Moon

(10) Patent No.: US 9,920,464 B2
(45) Date of Patent: Mar. 20, 2018

(54) CAMOUFLAGE CLOTHING WOVEN USING DYED THREADS AND JACQUARD WEAVING MACHINE AND METHOD OF WEAVING THE SAME

(71) Applicant: Jae Hyuk Moon, Daegu (KR)

(72) Inventor: Jae Hyuk Moon, Daegu (KR)

(73) Assignee: DONG-A TOL CO., LTD., Daegu (KR)

( * ) Notice: Subject to any disclaimer, the term of this patent is extended or adjusted under 35 U.S.C. 154(b) by 0 days.

(21) Appl. No.: 15/388,680

(22) Filed: Dec. 22, 2016

(65) Prior Publication Data

US 2017/0362758 A1 Dec. 21, 2017

(30) Foreign Application Priority Data

Jun. 20, 2016 (KR) ..... 10-2016-0076567

(51) Int. Cl.
*D06C 23/00* (2006.01)
*D03D 1/00* (2006.01)

(52) U.S. Cl.
CPC ..... *D06C 23/00* (2013.01); *D03D 1/0047* (2013.01)

(58) Field of Classification Search
CPC ..... F41H 3/02; F41H 3/00; Y10S 428/919; Y10S 2/90; A41D 31/0011; D03D 13/008; D03D 15/00; D03D 13/00; D03D 1/0047
See application file for complete search history.

(56) References Cited

U.S. PATENT DOCUMENTS 3,899,620 A * 8/1975 Roeloffzen ..... F41H 3/02 428/112
4,557,965 A * 12/1985 Karlsson ..... H01Q 17/005 428/196
4,602,384 A * 7/1986 Schneider ..... A41D 13/012 441/103
4,606,966 A * 8/1986 Karlsson ..... H01Q 17/005 428/196
4,645,704 A * 2/1987 Hellwig ..... D06Q 1/04 427/270
4,671,988 A * 6/1987 Dowell ..... F41H 3/00 2/900
4,767,649 A * 8/1988 Birch ..... F41H 3/00 428/132

(Continued)

FOREIGN PATENT DOCUMENTS

KR 1677929 * 11/2016 ..... D03D 1/0047

*Primary Examiner* — Bobby Muromoto, Jr.
(74) *Attorney, Agent, or Firm* — John K. Park; Park Law Firm

(57) ABSTRACT

A method of manufacturing camouflage clothing worn by soldiers is provided. The optimum camouflage clothing satisfying clothing functionality, aesthetics, and camouflaging effect, which is an important function for military uniforms, is provided while the optimum camouflage clothing is economical. The camouflage clothing is formed by dyeing threads i.e. row material, using the dyed threads as warp threads and weft threads, and weaving the camouflage clothing using a jacquard weaving machine. Herein, the warp threads and the weft threads are gradationally arranged to form a delicate-colored checked pattern while a three-dimensional pattern is displayed by the jacquard weaving machine.

3 Claims, 23 Drawing Sheets
(14 of 23 Drawing Sheet(s) Filed in Color)

(56) References Cited

U.S. PATENT DOCUMENTS 4,879,171 A * 11/1989 Jeffrey ..... B32B 15/08 442/185
6,668,868 B2 * 12/2003 Howland ..... A41D 19/01505 139/383 R
6,787,212 B2 * 9/2004 Strength ..... B32B 3/26 428/102
7,244,684 B2 * 7/2007 Hexels ..... F41H 3/02 2/900
7,571,493 B1 * 8/2009 Purvis ..... F41H 1/02 2/2.5
7,592,276 B2 * 9/2009 Hill ..... D02G 3/441 313/511
7,659,217 B2 * 2/2010 Narayanan ..... A41D 31/0027 428/920
7,819,927 B2 * 10/2010 Greenspoon ..... D03D 15/00 42/131
8,013,776 B2 * 9/2011 Child ..... H01Q 17/005 342/1
8,236,714 B2 * 8/2012 Frankel ..... F41H 3/02 2/69
8,793,814 B1 * 8/2014 Dilanni ..... D02G 3/047 2/272
8,916,265 B1 * 12/2014 Kelsey ..... F41H 3/00 428/316.6
8,918,919 B2 * 12/2014 Scholz ..... A41D 31/0016 2/458
2003/0211797 A1 * 11/2003 Hill ..... D03D 1/0088 442/205
2004/0009729 A1 * 1/2004 Hill ..... D02G 3/441 442/208
2004/0127124 A1 * 7/2004 Hexels ..... F41H 3/02 442/131
2004/0157038 A1 * 8/2004 Strength ..... B32B 3/26 428/102
2006/0035555 A1 * 2/2006 Narayanan ..... A41D 31/0027 442/387
2006/0127570 A1 * 6/2006 Casburn ..... B41M 3/00 427/145
2007/0049147 A1 * 3/2007 Hill ..... D03D 1/0088 442/181
2008/0102724 A1 * 5/2008 Frankel ..... F41H 3/02 442/301
2008/0242175 A1 * 10/2008 Narayanan ..... A41D 31/0027 442/136
2009/0263644 A1 * 10/2009 Kelsey ..... F41H 3/00 428/315.9
2010/0093238 A1 * 4/2010 Schwarz ..... F41H 3/02 442/116
2010/0285285 A1 * 11/2010 Winterhalter ..... D02G 3/047 428/196
2011/0095931 A1 * 4/2011 Child ..... F41H 3/02 342/3
2014/0036355 A1 * 2/2014 Scholz ..... A41D 31/0016 359/360
2014/0154482 A1 * 6/2014 Jang ..... F41H 3/00 428/196
2014/0182050 A1 * 7/2014 Ameil ..... A62D 5/00 2/457
2014/0234592 A1 * 8/2014 Ruediger ..... A41D 31/0022 428/196
2015/0000088 A1 * 1/2015 King ..... A44B 18/0003 24/451
2015/0308041 A1 * 10/2015 Schmitt ..... D06P 3/24 8/650

* cited by examiner

CAMOUFLAGE CLOTHING WOVEN USING DYED THREADS AND JACQUARD WEAVING MACHINE AND METHOD OF WEAVING THE SAME

CROSS-REFERENCE TO RELATED APPLICATION

This application claims priority to Korean Patent Application No. 10-2016-0128198, filed on Oct. 5, 2016 in the Korean Intellectual Property Office, the disclosure of which is incorporated herein by reference.

BACKGROUND OF THE INVENTION

1. Field of the Invention

The present invention relates to camouflage clothing in which dyed warp threads having various colors and dyed weft threads having various colors are used to display a suitable color for camouflage instead of printing a camouflage pattern on dobby fabric, and the camouflage pattern is effectively provided with plain weave and twill weave using a jacquard weaving machine, thereby improving clothing functionality and camouflaging effect.

2. Description of the Related Art

In general, optimum military uniforms worn by soldiers satisfy both clothing functionality and camouflaging effect.

To this end, every country has developed and applied military uniforms having a camouflage pattern suited to geographical features thereof.

Furthermore, the military uniforms having functionality allow an army group to be distinguished from other groups, and have a symbolic function in which soldiers feel a sense of belonging to the army group. Therefore, in term of an apparel study, the military uniforms may combine various functions.

As a means for realizing complex functions, recently, rip stop contexture having a checked pattern is used as a fabric and patterns are printed on the fabric using a digital print.

However, in the case where the fabric woven with the rip stop contexture is printed to form the military uniforms, surface aesthetics of the fabric are flat so as to have insufficient three-dimensional look or texture. Furthermore, the fabric is printed using a predetermined quantity of colors, such that boundaries of printed patterns are clearly defined. Camouflaging effect is decreased since the displayed colors are limited.

In addition, after the woven fabric is printed using the printing method, there are post-processes such as steaming for fixing dye into the printed fabric and rinsing the steamed fabric, thereby spending lots of time and money.

Meanwhile, there are prior arts about a method of manufacturing the camouflage clothing, such as Korean patent No. 10-1996-000874 entitled by "PRINTED INFRARED CAMOUFLAGE CLOTHING WITH COMPLEX COLORS" (patent document 1), Korean patent No. 10-1989-0002178 entitled by "METHOD OF MANUFACTURING INFRARED CAMOUFLAGE CLOTHING" (patent document 2), and Korean patent No. 10-1989-0002179 entitled by "METHOD OF MANUFACTURING VISUAL AND INFRARED CAMOUFLAGE CLOTHING WITH COMPLEX PATTERN" (patent document 3).

In the case of the above patent documents, the woven fabric is printed using dye having complex colors. However, the camouflage clothing has insufficient three-dimensional look or texture and lacks displaying camouflaging effect.

SUMMARY OF THE INVENTION

Therefore, the present invention has been made in view of the above problems, and it is an object of the present invention to provide the optimum camouflage clothing satisfying clothing functionality, aesthetics, and camouflaging effect, which is an important function for military uniforms while being economical, in terms of manufacturing camouflage clothing worn by soldiers.

In accordance with an aspect of the present invention, the above and other objects of the present invention can be accomplished by the provision of camouflage clothing formed by dyeing threads i.e. row material, using the dyed threads as warp threads and weft threads, and weaving the camouflage clothing using a jacquard weaving machine. Herein, the warp threads and the weft threads are gradationally arranged to form a delicate-colored checked pattern while a three-dimensional pattern is displayed by the jacquard weaving machine.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
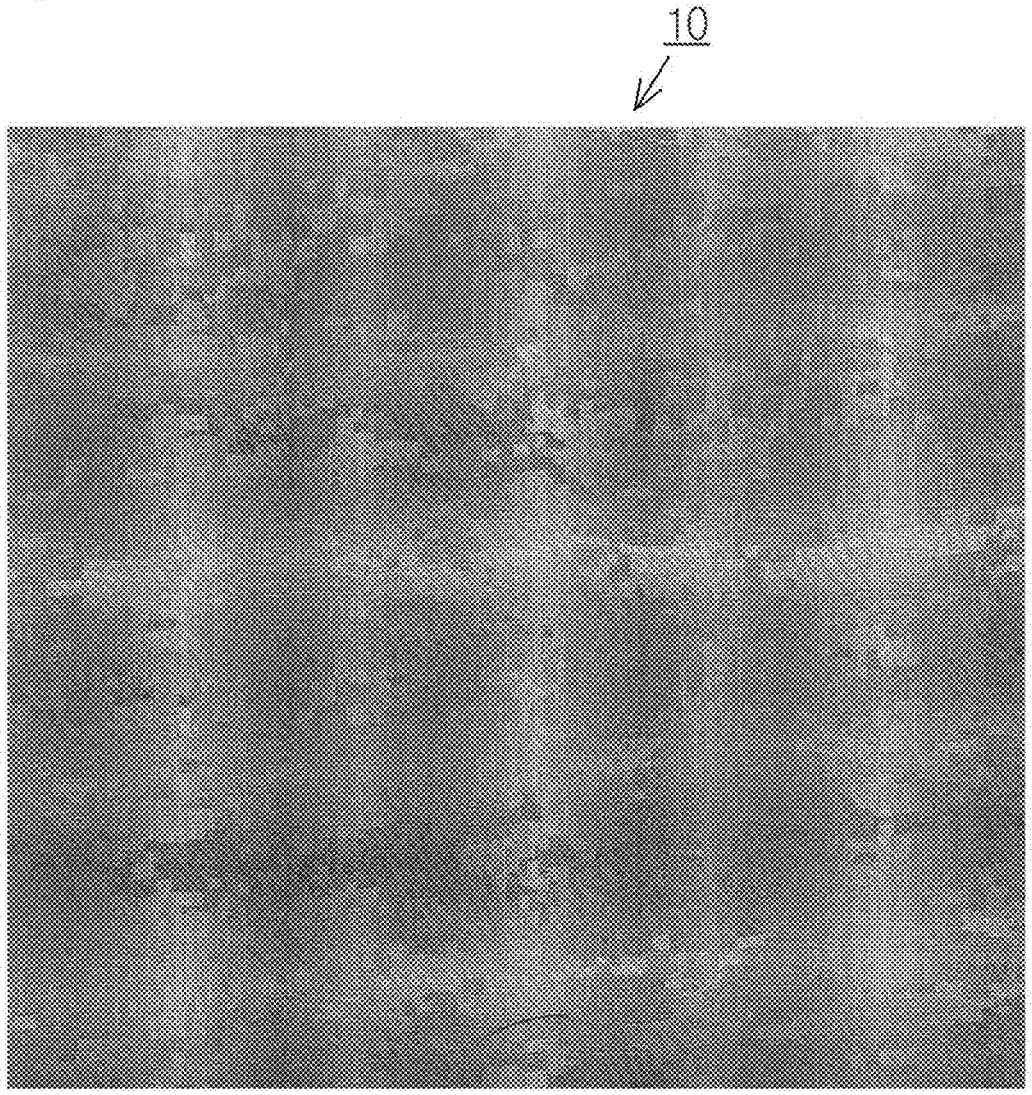
FIG. 1 is a picture of camouflage clothing according to an embodiment of the present invention.

Hereinafter, reference will now be made in detail to various embodiments of the present invention, examples of which are illustrated in the accompanying drawings and described below.

According to the present invention, threads including warp threads and weft threads are dyed by various colors, the dyed threads are used as the warp threads and the weft threads, and the dyed threads are gradationally arranged based on geographical features in order to be suitable for camouflage, such that a checked pattern having a delicate color is formed. A jacquard weaving machine is used to form the desired camouflage pattern in three dimensions, such that the camouflage clothing having functionality, aesthetics, and high quality, which is highly effective in camouflaging effect.

In a process of weaving the camouflage clothing, the threads used as the warp threads and the weft threads are made of 40/2 twisted threads including polyester and rayon. The colored threads based on seasonal and geographical features and a gradient arrangement manner may be selected. The various camouflage patterns may be woven using the jacquard weaving machine.

Hereinafter, the camouflage clothing weaving will be explained in detail according to embodiments of the present invention.

First Embodiment

The first embodiment includes a design based on a digital pattern of a new military uniform which is currently used. Five dyed warp threads WP and five dyed weft threads WT are arranged by color and weave by a jacquard weaving machine to form camouflage clothing 10. The warp threads WP and the weft threads WT are made of twisted threads (T/R40/2) including blended polyester/rayon (65:35). A density of the warp threads WP is 83T and a density of the weft threads WT is 72T.

However, the thickness of the threads or the densities of the warp and weft threads WP and WT may be changed based on a weaving design.

In color of the warp threads WP, first warp threads WP1 are dark green, second warp threads WP2 are green, third warp threads WP3 are light green, fourth warp threads WP4 are brown, and fifth warp threads WP5 are beige. One color arrangement cycle of the warp threads WP are 400 plies. The arrangement of the warp threads WP will be described below (see FIG. 9).

Namely, 10 plies of the first dark green warp threads WP1, 1 ply of the second green warp threads WP2, and 3 plies of the first dark green warp threads WP1 are arranged. 1 ply of the second warp threads WP2 and 2 plies of the first warp threads WP1 are repeatedly arranged twice. 1 ply of the second warp threads WP2 and 1 ply of the first warp threads WP1 are repeatedly arranged five times. 2 plies of the second warp threads WP2 and 1 ply of the first warp threads WP1 are repeatedly arranged twice. 3 plies of the second warp threads WP2 and 1 ply of the first warp threads WP1, and 10 plies of the second warp threads WP2 are arranged.

Then, 1 ply of the third light green warp threads WP3 and 3 plies of the second warp threads WP2 are arranged. 1 ply of the third warp threads WP3 and 2 plies of the second warp threads WP2 are repeatedly arranged twice. 1 ply of the third warp threads WP3 and 1 ply of the second warp threads WP2 are repeatedly arranged five times. 2 plies of the third warp threads WP3 and 1 ply of the second warp threads WP2 are repeatedly arranged twice. 3 plies of the warp threads WP3, 1 ply of the second warp threads WP2, 10 plies of the third warp threads WP3, 1 ply of the second warp threads WP2, and 3 plies of the warp threads WP3 are arranged.

1 ply of the second warp threads WP2 and 2 plies of the third warp threads WP3 are repeatedly arranged twice. 1 ply of the warp threads WP2 and 1 ply of the third warp threads WP3 are repeatedly arranged five times. 2 plies of the second warp threads WP2 and 1 ply of the third warp threads WP3 are repeatedly arranged twice. 3 plies of the second warp threads WP2, 1 ply of the third warp threads WP3, and 10 plies of the second warp threads WP2 are arranged.

1 ply of the fourth brown warp threads WP4 and 3 plies of the second warp threads WP2 are arranged. 1 ply of the fourth warp threads WP4 and 2 plies of the second warp threads WP2 are repeatedly arranged twice. 1 ply of the fourth warp threads WP4 and 1 ply of the second warp threads WP2 are repeatedly arranged five times. 2 plies of the fourth warp threads WP4 and 1 ply of the second warp threads WP2 are repeatedly arranged twice. 3 plies of the fourth warp threads WP4, 1 ply of the second warp threads WP2, 10 plies of the fourth warp threads WP4, 1 ply of the second warp threads WP2, and 3 plies of the fourth warp threads WP4 are arranged.

1 ply of the second warp threads WP2 and 2 plies of the fourth warp threads WP4 are repeatedly arranged twice. 1 ply of the second warp threads WP2 and 1 ply of the fourth warp threads WP4 are repeatedly arranged five times. 2 plies of the second warp threads WP2 and 1 ply of the fourth warp threads WP4 are repeated arranged twice. 3 plies of the second warp threads WP2, 1 ply of the fourth warp threads WP4, 10 plies of the second warp threads WP2, 1 ply of the third warp threads WP3, and 3 plies of the second warp threads WP2 are arranged.

1 ply of the third warp threads WP3 and 2 plies of the second warp threads WP2 are repeatedly arranged twice. 1 ply of the third warp threads WP3 and 1 ply of the second warp threads WP2 are repeatedly arranged five times. 2 plies of the third warp threads WP3 and 1 ply of the second warp threads WP2 are repeatedly arranged twice. 2 plies of the third warp threads WP3 and 1 ply of the second warp threads WP2 are repeatedly arranged twice. 3 plies of the third warp threads WP3, 1 ply of the second warp threads WP2, and 10 plies of the third warp threads WP3 are arranged.

1 ply of the fifth beige warp threads WP5 and 3 plies of the third warp threads WP3 are arranged. 1 ply of the fifth warp threads WP5 and 2 plies of the third warp threads WP3 are repeatedly arranged twice. 1 ply of the fifth warp threads WP5 and 1 ply of the third warp threads WP3 are repeatedly arranged five times. 2 plies of the fifth warp threads WP5 and 1 ply of the third warp threads WP3 are repeatedly arranged twice. 3 plies of the fifth warp threads WP5, 1 ply of the third warp threads WP3, 10 plies of the fifth warp threads WP5, 1 ply of the third warp threads WP3, and 3 plies of the fifth warp threads WP5 are arranged.

1 ply of the third warp threads WP3 and 2 plies of the fifth warp threads WP5 are repeated arranged twice. 1 ply of the third warp threads WP3 and 1 ply of the fifth warp threads WP5 are repeatedly arranged five times. 2 plies of the third warp threads WP3 and 1 ply of the fifth warp threads WP5 are repeatedly arranged twice. 3 plies of the third warp threads WP3, 1 ply of the fifth warp threads WP5, 10 plies of the third warp threads WP3, 1 ply of the second warp threads WP2, and 3 plies of the third warp threads WP3 are arranged.

1 ply of the second warp threads WP2 and 2 plies of the third warp threads WP3 are repeatedly arranged twice. 1 ply of the second warp threads WP2 and 1 ply of the third warp threads WP3 are repeatedly arranged five times. 2 plies of the second warp threads WP2 and 1 ply of the third warp threads WP3 are repeatedly arranged twice. 3 plies of the second warp threads WP2, 1 ply of the third warp threads WP3, 10 plies of the second warp threads WP2, 1 ply of the first warp threads WP1, and 3 plies of the second warp threads WP2 are arranged.

1 ply of the first warp threads WP1 and 2 plies of the second warp threads WP2 are repeatedly arranged twice. 1 ply of the first warp threads WP1 and 1 ply of the second warp threads WP2 are repeatedly arranged five times. 2 plies of the first warp threads WP1 and 1 ply of the second warp threads WP2 are repeatedly arranged twice. 3 plies of the first warp threads WP1 and 1 ply of the second warp threads WP2 are arranged.

The warp threads WP are arranged as described above. Herein, 400 plies of the warp threads WP, which include 40 plies of the first dark green warp threads WP1, 160 plies of the second green warp threads WP2, 120 plies of the third light green warp threads WP3, 40 plies of the fourth brown warp threads WP4, and 40 plies of the fifth beige warp threads WP5, constitute one color cycle. The warp threads WP are repeatedly arranged with the colors cycle. The repeatedly arranged warp threads WP are wound onto a warp beam. The warp beam is mounted at the jacquard weaving machine.

Figure 9:
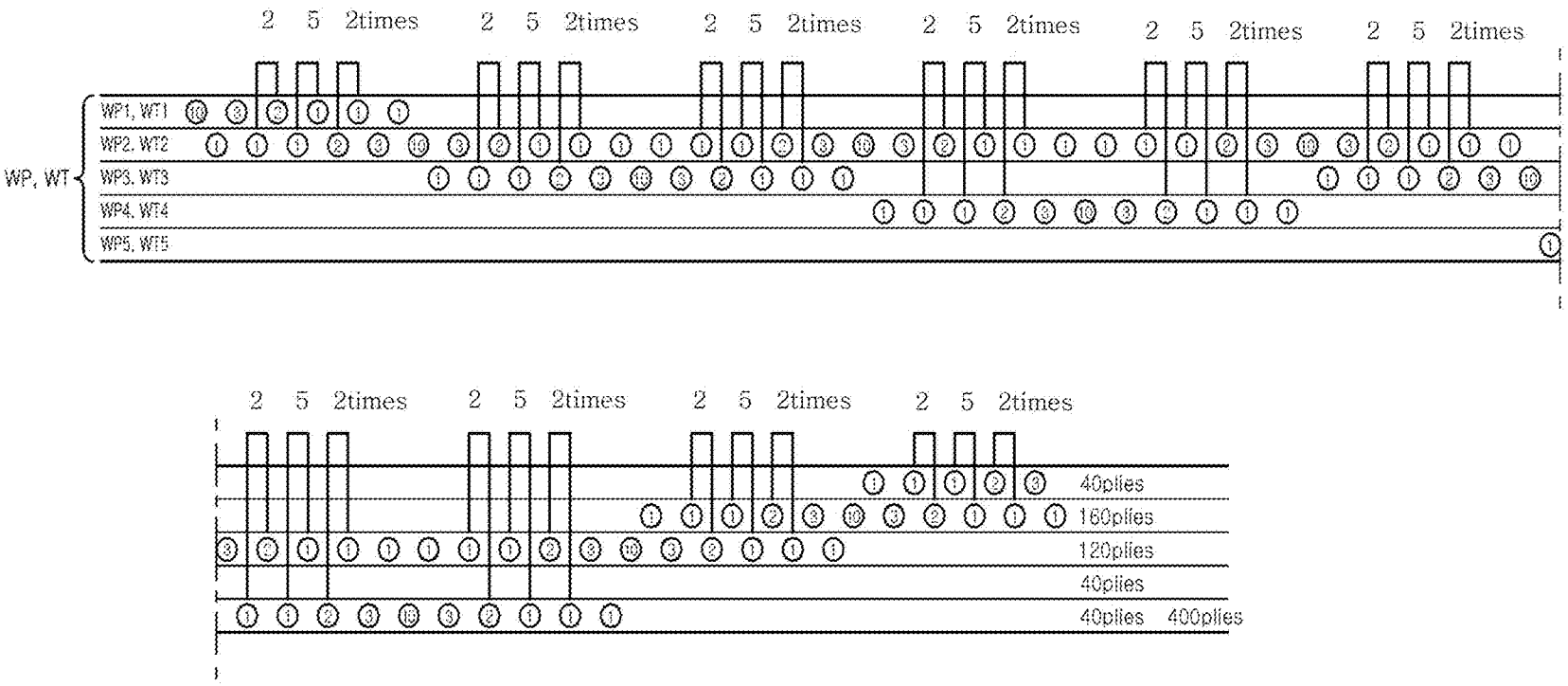
FIG. 9 is an order of arrangement of warp threads and weft threads for weaving the camouflage clothing of FIG. 1.

An arrangement order and colors of the weft threads WT are the same as the arrangement order and color of the warp threads WP (see FIG. 9).

However, the arrangement order and the colors of the warp threads WP are determined in a process of the warp beaming. In the case of the weft threads WT, the arrangement order of the warp threads is determined by insertion order of the weft threads WT into the opened warp threads WP. The colors of the weft threads WT arranged according to the insertion order will be described.

Namely, first weft threads WT1 are dark green, second weft threads WT2 are green, third weft threads WT3 are light green, fourth weft threads WT4 are brown, and fifth weft threads WT5 are beige.

In the arrangement of the weft threads WT, 10 plies of the first dark green weft threads WT1, 1 ply of the second green weft threads WT2, and 3 plies of the first dark green weft threads WT1 are arranged. 1 ply of the second weft threads WT2 and 2 plies of the first weft threads WT1 are repeatedly arranged twice. 1 ply of the second weft threads WT2 and 1 ply of the first weft threads WT1 are repeatedly arranged five times. 2 plies of the second weft threads WT2 and 1 ply of the first weft threads WT1 are repeatedly arranged twice. 3 plies of the second weft threads WT2 and 1 ply of the first weft threads WT1, and 10 plies of the second weft threads WT2 are arranged.

Then, 1 ply of the third light green weft threads WT3 and 3 plies of the second weft threads WT2 are arranged. 1 ply of the third weft threads WT3 and 2 plies of the second weft threads WT2 are repeatedly arranged twice. 1 ply of the third weft threads WT3 and 1 ply of the second weft threads WT2 are repeatedly arranged five times. 2 plies of the third weft threads WT3 and 1 ply of the second weft threads WT2 are repeatedly arranged twice. 3 plies of the weft threads WT3, 1 ply of the second weft threads WT2, 10 plies of the third weft threads WT3, 1 ply of the second weft threads WT2, and 3 plies of the weft threads WT3 are arranged.

1 ply of the second weft threads WT2 and 2 plies of the third weft threads WT3 are repeatedly arranged twice. 1 ply of the weft threads WT2 and 1 ply of the third weft threads WT3 are repeatedly arranged five times. 2 plies of the second weft threads WT2 and 1 ply of the third weft threads WT3 are repeatedly arranged twice. 3 plies of the second weft threads WT2, 1 ply of the third weft threads WT3, and 10 plies of the second weft threads WT2 are arranged.

1 ply of the fourth brown weft threads WT4 and 3 plies of the second weft threads WT2 are arranged. 1 ply of the fourth weft threads WT4 and 2 plies of the second weft threads WT2 are repeatedly arranged twice. 1 ply of the fourth weft threads WT4 and 1 ply of the second weft threads WT2 are repeatedly arranged five times. 2 plies of the fourth weft threads WT4 and 1 ply of the second weft threads WT2 are repeatedly arranged twice. 3 plies of the fourth weft threads WT4, 1 ply of the second weft threads WT2, 10 plies of the fourth weft threads WT4, 1 ply of the second weft threads WT2, and 3 plies of the fourth weft threads WT4 are arranged.

1 ply of the second weft threads WT2 and 2 plies of the fourth weft threads WT4 are repeatedly arranged twice. 1 ply of the second weft threads WT2 and 1 ply of the fourth weft threads WT4 are repeatedly arranged five times. 2 plies of the second weft threads WT2 and 1 ply of the fourth weft threads WT4 are repeated arranged twice. 3 plies of the second weft threads WT2, 1 ply of the fourth weft threads WT4, 10 plies of the second weft threads WT2, 1 ply of the third weft threads WT3, and 3 plies of the second weft threads WT2 are arranged.

1 ply of the third weft threads WT3 and 2 plies of the second weft threads WT2 are repeatedly arranged twice. 1 ply of the third weft threads WT3 and 1 ply of the second weft threads WT2 are repeatedly arranged five times. 2 plies of the third weft threads WT3 and 1 ply of the second weft threads WT2 are repeatedly arranged twice. 2 plies of the third weft threads WT3 and 1 ply of the second weft threads WT2 are repeatedly arranged twice. 3 plies of the third weft threads WT3, 1 ply of the second weft threads WT2, and 10 plies of the third weft threads WT3 are arranged.

1 ply of the fifth beige weft threads WT5 and 3 plies of the third weft threads WT3 are arranged. 1 ply of the fifth weft threads WT5 and 2 plies of the third weft threads WT3 are repeatedly arranged twice. 1 ply of the fifth weft threads WT5 and 1 ply of the third weft threads WT3 are repeatedly arranged five times. 2 plies of the fifth weft threads WT5 and 1 ply of the third weft threads WT3 are repeatedly arranged twice. 3 plies of the fifth weft threads WT5, 1 ply of the third weft threads WT3, 10 plies of the fifth weft threads WT5, 1 ply of the third weft threads WT3, and 3 plies of the fifth weft threads WT5 are arranged.

1 ply of the third weft threads WT3 and 2 plies of the fifth weft threads WT5 are repeated arranged twice. 1 ply of the third weft threads WT3 and 1 ply of the fifth weft threads WT5 are repeatedly arranged five times. 2 plies of the third weft threads WT3 and 1 ply of the fifth weft threads WT5 are repeatedly arranged twice. 3 plies of the third weft threads WT3, 1 ply of the fifth weft threads WT5, 10 plies of the third weft threads WT3, 1 ply of the second weft threads WT2, and 3 plies of the third weft threads WT3 are arranged.

1 ply of the second weft threads WT2 and 2 plies of the third weft threads WT3 are repeatedly arranged twice. 1 ply of the second weft threads WT2 and 1 ply of the third weft threads WT3 are repeatedly arranged five times. 2 plies of the second weft threads WT2 and 1 ply of the third weft threads WT3 are repeatedly arranged twice. 3 plies of the second weft threads WT2, 1 ply of the third weft threads WT3, 10 plies of the second weft threads WT2, 1 ply of the first weft threads WT1, and 3 plies of the second weft threads WT2 are arranged.

1 ply of the first weft threads WT1 and 2 plies of the second weft threads WT2 are repeatedly arranged twice. 1 ply of the first weft threads WT1 and 1 ply of the second weft threads WT2 are repeatedly arranged five times. 2 plies of the first weft threads WT1 and 1 ply of the second weft threads WT2 are repeatedly arranged twice. 3 plies of the first weft threads WT1 and 1 ply of the second weft threads WT2 are arranged.

The weft threads WT are arranged as described above. Herein, 400 plies of the weft threads WT, which include 40 plies of the first dark green weft threads WT1, 160 plies of the second green weft threads WT2, 120 plies of the third light green weft threads WT3, 40 plies of the fourth brown weft threads WT4, and 40 plies of the fifth beige weft threads WT5, constitute one color cycle. The weft threads WT are repeatedly arranged with the colors cycle.

As described above, 400 plies of the warp threads WP distinguished by color are formed as one color cycle and are wound onto the warp beam to repeat the colors cycle. Then, the warp beam is mounted at the jacquard weaving machine and the weft threads WT are sequentially inserted between the warp threads WP to weave the camouflage clothing 10.

Figure 2:
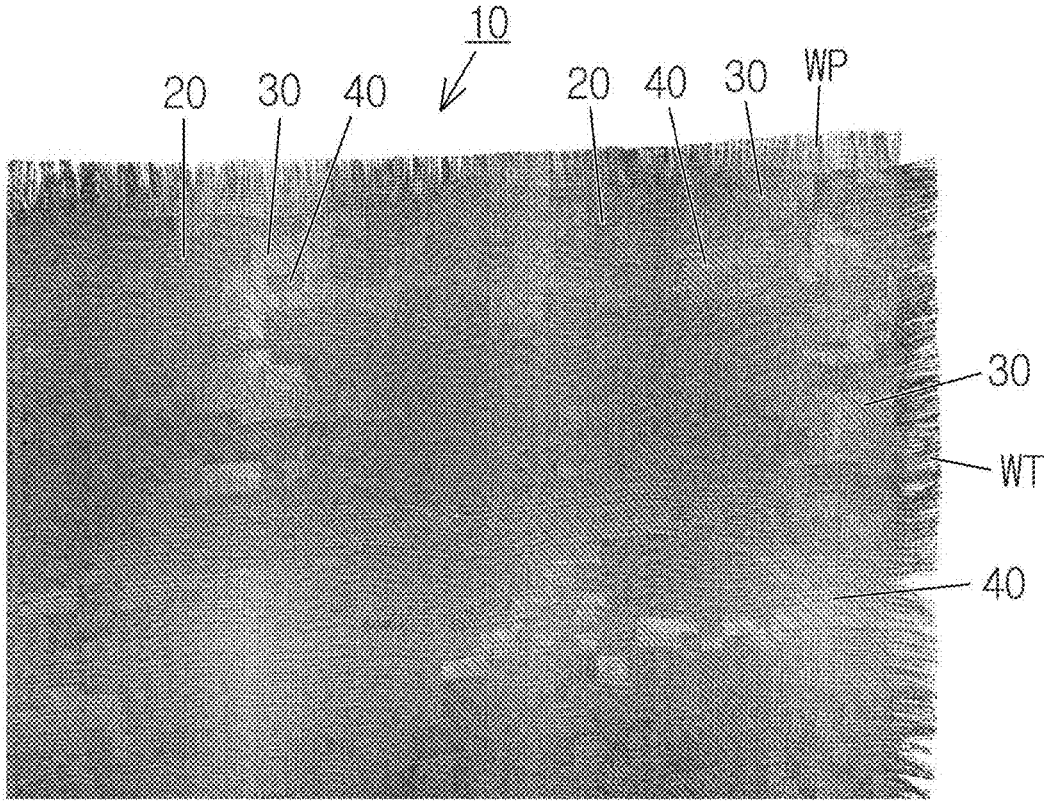
FIG. 2 is an enlarged picture of FIG. 1.

As illustrated in FIGS. 1 and 2, the camouflage clothing 10 includes an alternate pattern 20 woven by 1/1 plain weave 21, a first pattern 30 woven by 3/1 warp twill weave 31, and a second pattern 40 woven by 1/3 weft twill weave 41.

Accordingly, since the camouflage clothing 10 includes the first pattern 30 woven by the warp twill weave 31 and the second pattern 40 woven by the weft twill weave 41 as well as the alternate pattern 20 woven by plain weave 21, various three-dimensional patterns are formed in the camouflage clothing 10. As a result, the arrangement order and the colors of the warp threads WP and the weft threads WT, as described above, display a delicate checked pattern. Therefore, the camouflage clothing 10 having high camouflaging effect may be obtained.

That is, in the case of 1/1 plain weave, the warp threads WP and the weft threads WT are crossly arranged at 1:1 to be perpendicular to each other. The first pattern 30 is woven by 3/1 warp twill weave 31, such that the first pattern 30 largely displays the color of the warp threads WP at surfaces of the camouflage clothing 10. The second pattern 40 is woven by 1/3 weft twill weave 41, such that the second pattern 40 largely displays the color of the weft threads WT at surfaces of the camouflage clothing 10. Thereby, the three-dimensional patterns are displayed at the camouflage clothing 10 and the desired color is freely expressed so as to improve camouflaging effect.

Second Embodiment

Figure 3:
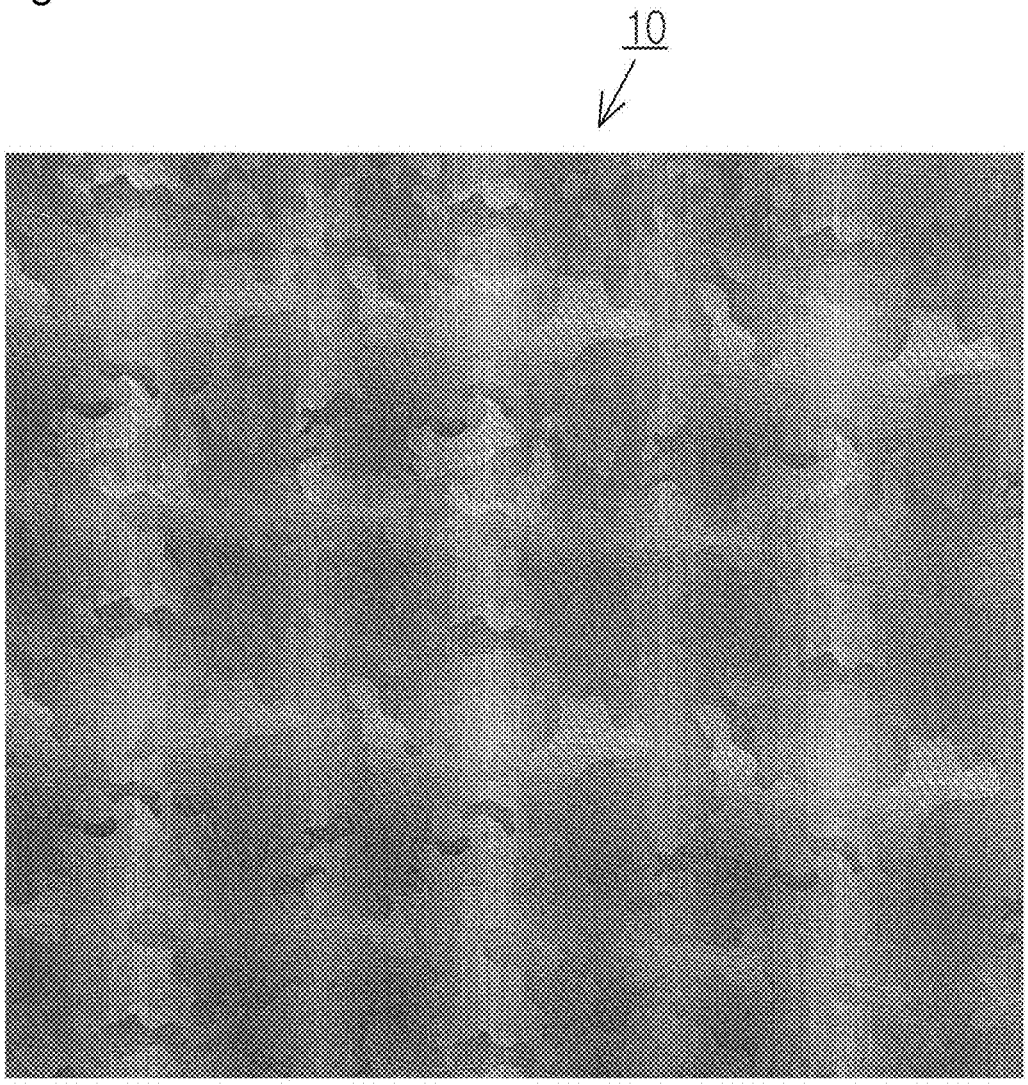
FIG. 3 is a picture of camouflage clothing according to another embodiment of the present invention.
Figure 4:
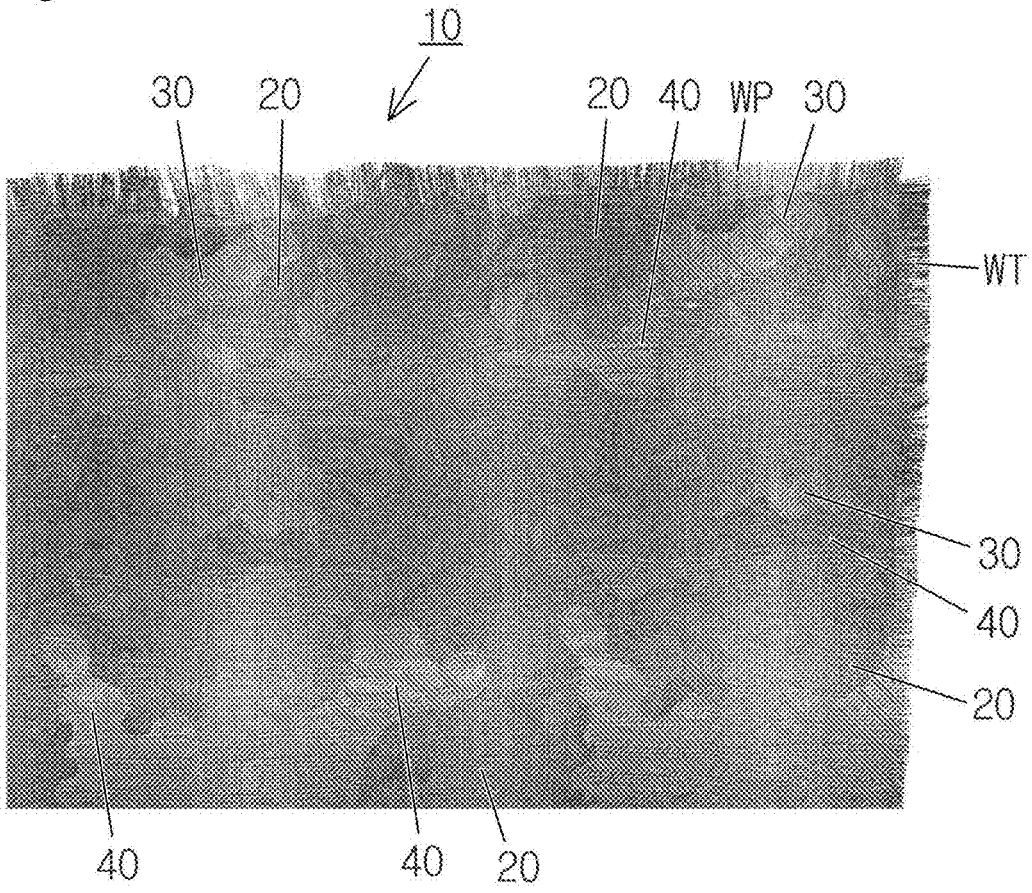
FIG. 4 is an enlarged picture of FIG. 3.

In the case of the second embodiment, an arrangement order and colors of warp threads WP and weft threads WT are the same as those of the first embodiment. However, in the weaving process, a design including an alternate pattern 20 woven by 1/1 plain weave 21, a first pattern 30 woven by 3/1 warp twill weave 31, and a second pattern 40 woven by 1/3 weft twill weave 41 differs from the first embodiment. Thereby, as illustrated in FIGS. 3 and 4, a wood-land pattern (a spotted pattern) having aesthetics of an old-type military uniform (used before 2011) is displayed.

Conditions and density of the warp threads WP and the weft threads WT are the same as those of the first embodiment.

Third Embodiment

In the case of the third embodiment, an arrangement order and colors of warp threads WP and weft threads WT are the same as those of the first embodiment. However, in the weaving process, Uragiri (Japanese term) weaving technique is applied. Uragiri is a fabric having protruding threads and is made by weaving a double weave at a desired part of a fabric and cutting the double woven part such that the threads remain.

Figure 7:
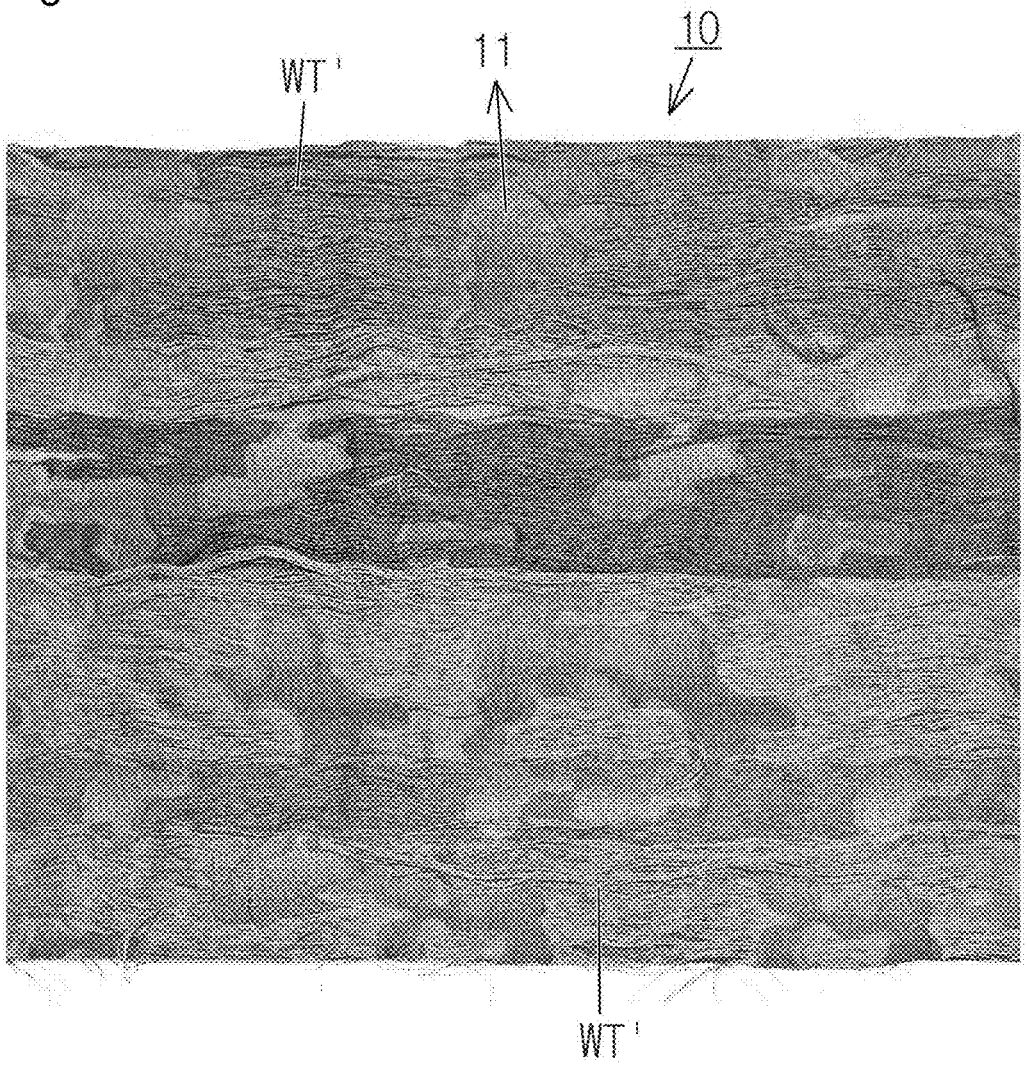
FIG. 7 is a rear-side picture in the state before cutting weft threads of FIG. 5.
Figure 8:
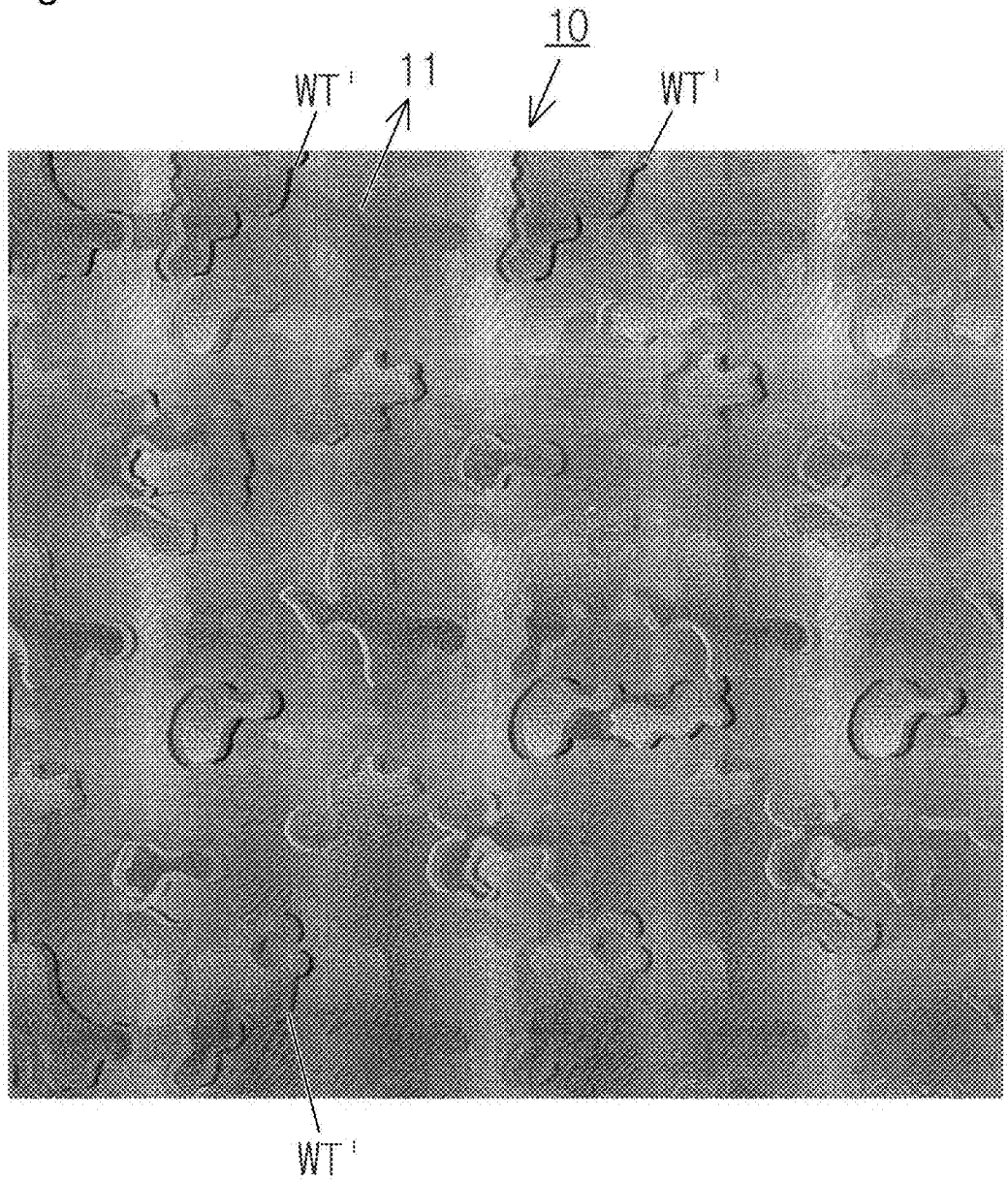
FIG. 8 is a cutting state of the weft threads of FIG. 7.

Ura means "lining" or "inside", and Giri means "cutting". In the fabric, "Uragiri" is a special textile instead of a general textile which is woven by plain weave, twill weave, or interweave of the warp threads and the weft threads such as satin weave. Hereinafter, a process of manufacturing Uragiri will be described. As illustrated in FIG. 7, during an insertion process of the weft threads WT', a part of the weft threads WT' disposed at one side 11 of the camouflage clothing 10 is lengthy woven not to be perpendicular to the warp threads WP. As illustrated in FIG. 8, after weaving, the long woven part of the weft threads WT' is cut and the cut weft threads WT' are sheared to be adjacent to a plane perpendicular to the warp threads WP. Thereby, "Uragiri" means cutting the protruding threads at the one side 11 of the fabric.

Figure 5:
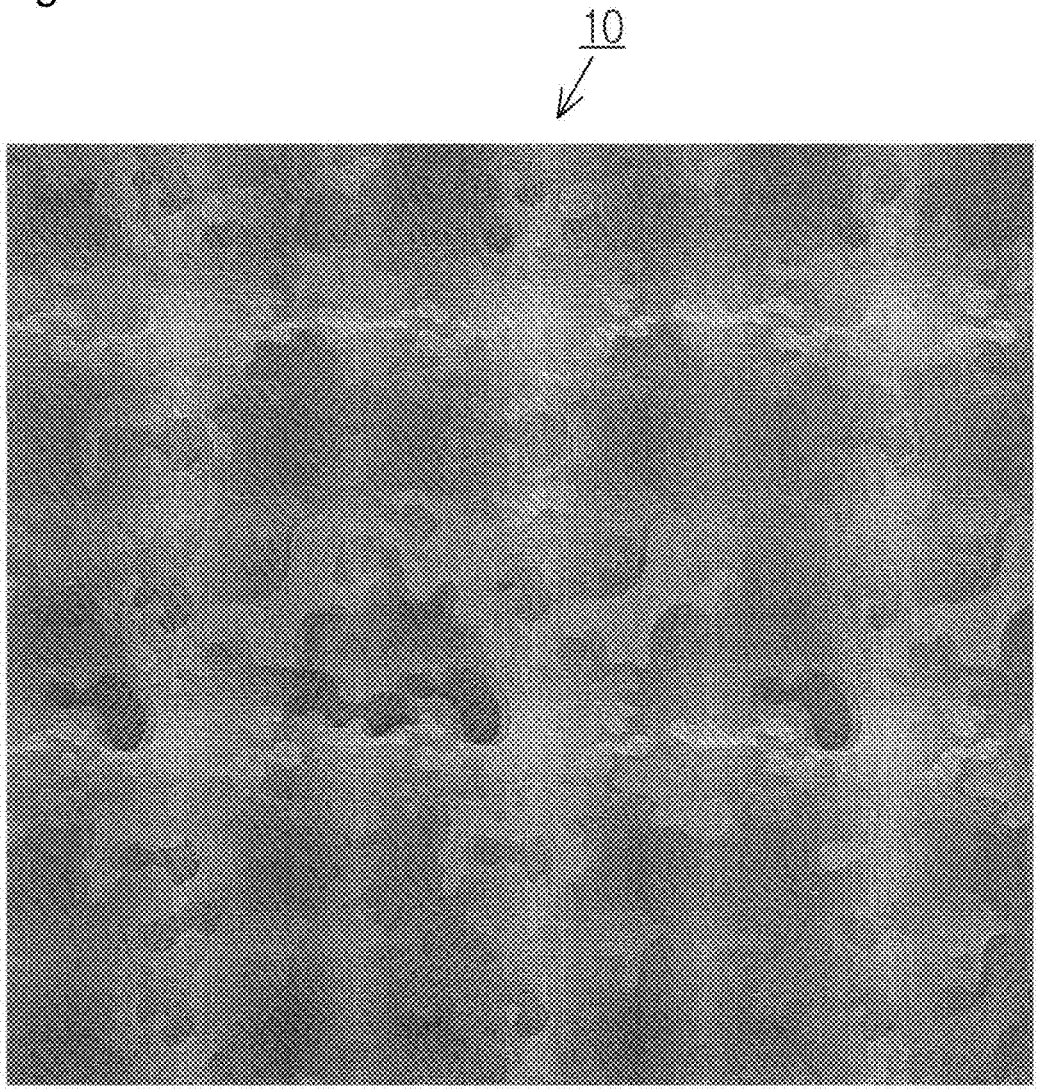
FIG. 5 is a picture of camouflage clothing woven by Uragiri according to the present invention.
Figure 6:
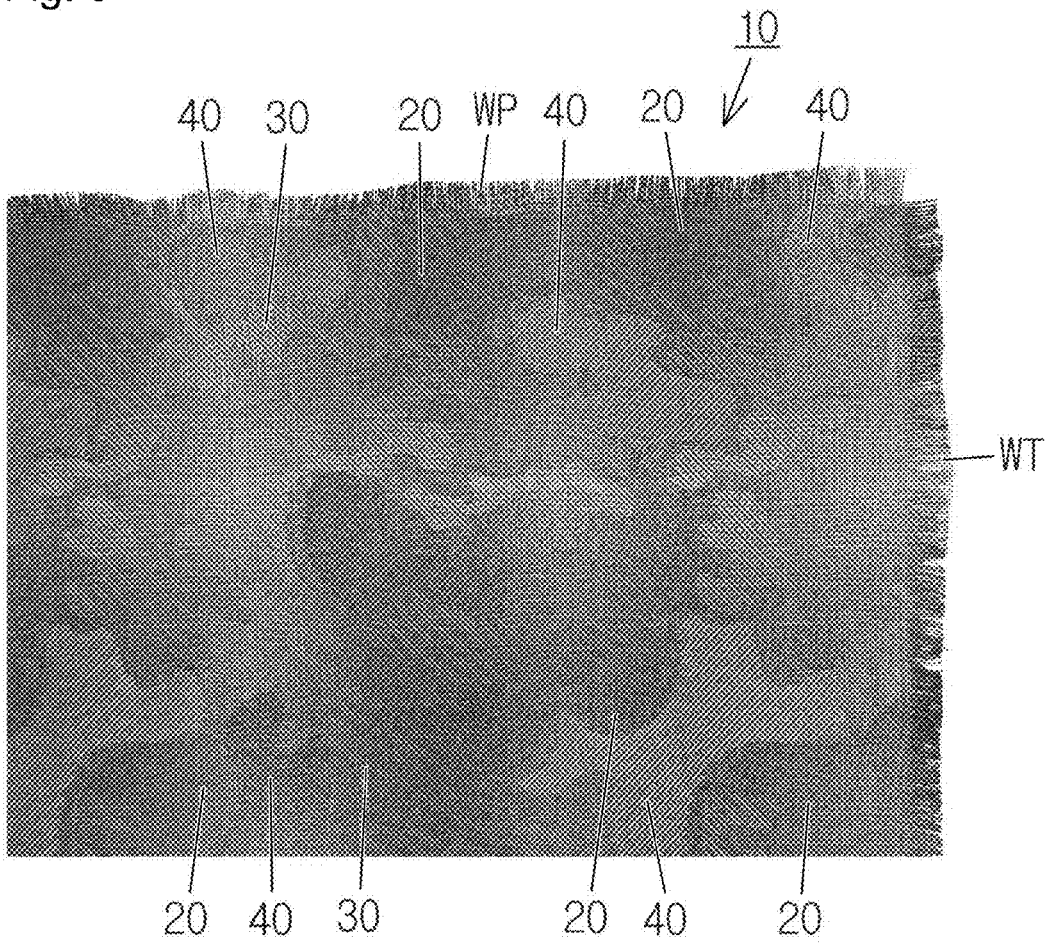
FIG. 6 is an enlarged picture of FIG. 5.

In the third embodiment, in comparison with the first and second embodiments in which the camouflage pattern is displayed using plain weave 21, warp twill weave 31, and weft twill weave 41, Uragiri which is the special textile is applied such that it is possible to display a pattern clearer and more three-dimensional than those of the first and second embodiments. Thereby, camouflaging effect may be maximized according to seasons, localities, and geographical features to which the camouflage clothing 10 is applied. The camouflage clothing 10 is illustrated in FIGS. 5 and 6.

In the third embodiment, conditions of the warp and weft threads WP and WT and the density of the warp threads WP is the same as those of the first embodiment. However, the weft threads WT are woven to have a density of 136T.

In the first to third embodiments, the colors of the warp and weft threads WP and WT are limited to 5 different colors, namely, the first warp and weft threads WP1 and WT1 are dark green, the second warp and weft threads WP2 and WT2 are green, the third warp and weft threads WP3 and WT3 are light green, the fourth warp and weft threads WP4 and WT4 are brown, and the fifth warp and weft threads WP5 and WT5 are beige. However, the colors of the warp and weft threads WP and WT may be selected according to seasons, localities, and geographical features.

Fourth Embodiment

The fourth embodiment is based on a digital pattern. Dyed warp threads WP having 8 different colors and dyed weft threads WT having different colors are arranged and are woven using a jacquard weaving machine to form camouflage clothing 10. The threads used as the warp threads WP and the weft threads WT are made of 40/2 twisted threads including polyester and rayon (65:35). A density of the warp threads WT is 83T and a density of the weft threads is 72T.

However, a thickness of threads or the densities of the warp and weft threads may be changed by based on a weaving design.

Figure 14:
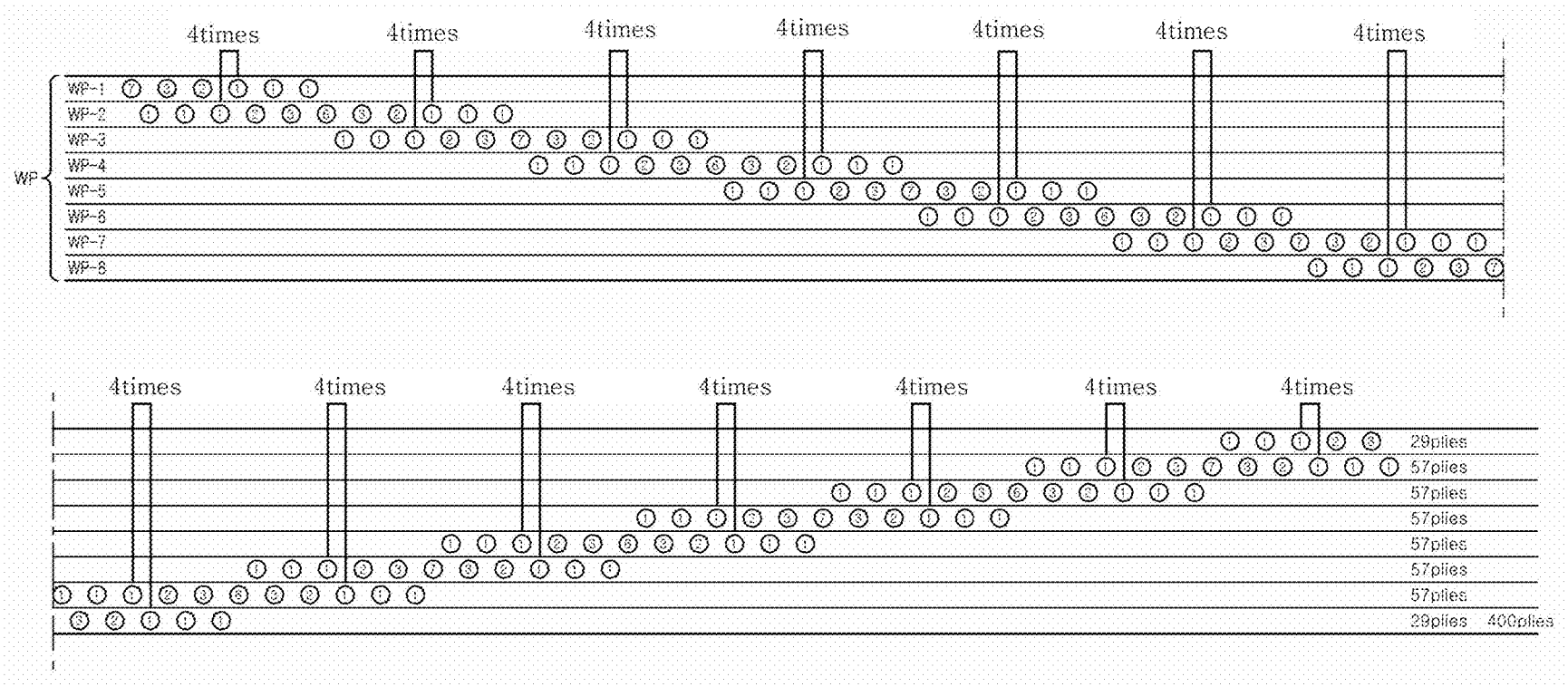
FIG. 14 is an order of arrangement of warp threads for weaving the camouflage clothing of FIG. 10.
Figure 15:
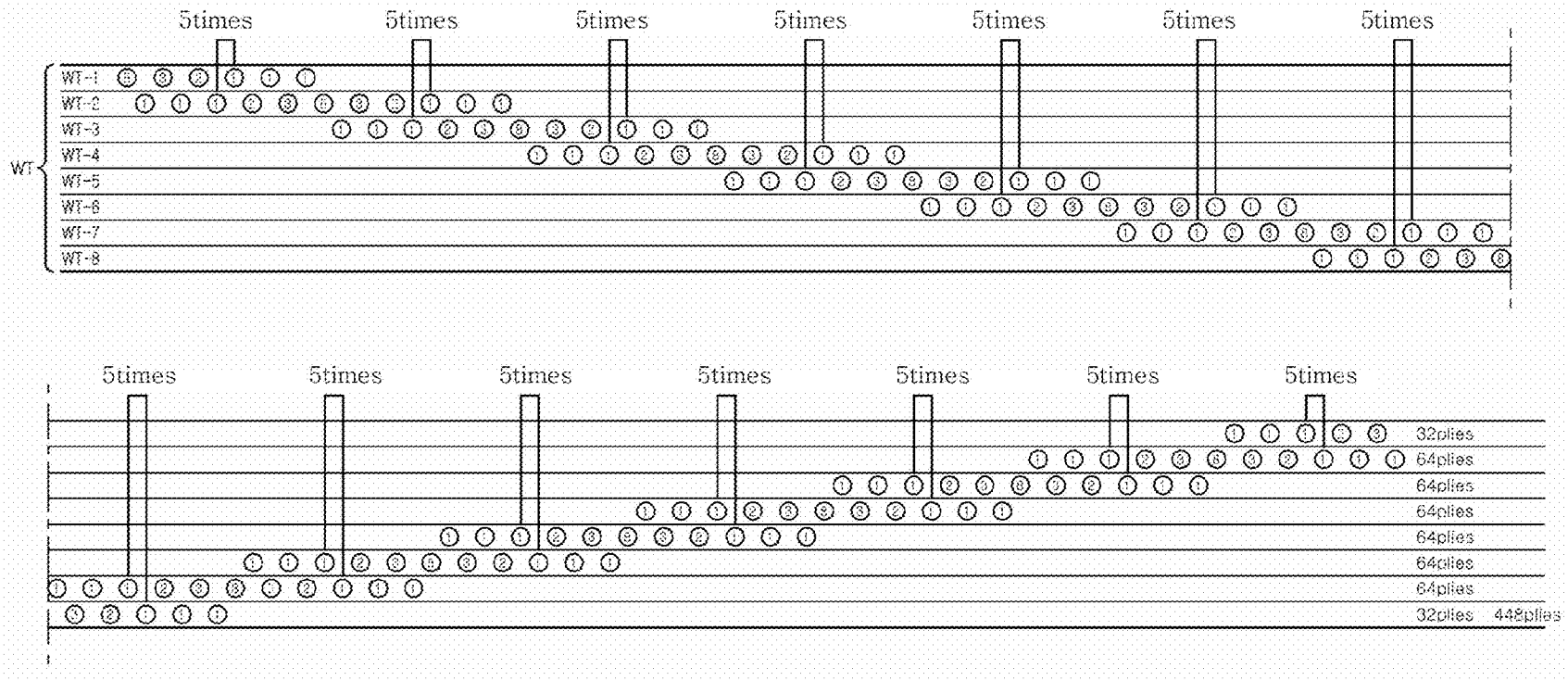
FIG. 15 is an order of arrangement of weft threads for weaving the camouflage clothing of FIG. 10.

In colors of the warp threads WP, first warp threads WP-1 re darker khaki, second warp threads WP-2 are dark khaki, third warp threads WP-3 are khaki, fourth warp threads WP-4 are light khaki, fifth warp threads WP-5 are light green, sixth warp threads WP-6 are dark beige, seventh warp threads WP-7 are brown, and eighth warp threads WP-8 are dark brown. One colors and arrangement cycle of the warp threads WP is 400 plies. The warp threads WP are repeatedly arranged with the color arrangement cycle. The repeatedly arranged warp threads WP are wound onto a warp beam. The warp beam is mounted at the jacquard weaving machine. Hereinafter, arrangement of the warp threads WP will be described below (see FIG. 14).

That is, 7 plies of the first darker khaki warp threads WP-1, 1 ply of the second dark khaki warp threads WP-2, 3 plies of the first warp threads WP-1, 1 ply of the second warp threads WP-2, and 2 plies of the first warp threads WP-1 are arranged. 1 ply of the second warp threads WP-2 and 1 ply of the first warp threads WP-1 are repeatedly arranged four times. 2 plies of the second warp threads WP-2, 1 ply of the first warp threads WP-1, 3 plies of the second warp threads WP-2, 1 ply of the first warp threads WP-1, and 6 plies of the second warp threads WP-2 are arranged.

Then, 1 ply of the third khaki warp threads WP-3, 3 plies of the second warp threads WP-2, 1 ply of the third warp threads WP-3, and 2 plies of the second warp threads WP are arranged. 1 ply of the third warp threads WP-3 and 1 ply of the second warp threads WP-2 are repeatedly arranged four times. 2 plies of the third warp threads WP-3, 1 ply of the second warp threads WP-2, 3 plies of the third warp threads WP-3, 1 ply of the second warp threads WP-2, and 7 plies of the warp threads WP-3 are arranged.

Sequentially, 1 ply of the fourth light khaki warp threads WP-4, 3 plies of the third warp threads WP-3, 1 ply of the fourth warp threads WP-4, and 2 plies of the warp threads WP-3 are arranged. 1 ply of the fourth warp threads WP-4 and 1 ply of the third warp threads WP-3 are repeatedly arranged four times. 2 plies of the fourth warp threads WP-4, 1 ply of the third warp threads WP-3, 3 plies of the fourth warp threads WP-4, 1 ply of the third warp threads WP-3, and 6 plies of the fourth warp threads WP-4 are arranged.

Then, 1 ply of the fifth light green warp threads WP-5, 3 plies of the fourth warp threads WP-4, 1 ply of the fifth warp threads WP-5, and 2 plies of the fourth warp threads WP-4 are arranged. 1 ply of the fifth warp threads WP-5 and 1 ply of the fourth warp threads WP-4 are repeatedly arranged four times. 2 plies of the fifth warp threads WP-5, 1 ply of the fourth warp threads WP-4, 3 plies of the fifth warp threads WP-5, 1 ply of the fourth warp threads WP-4, and 7 plies of the fifth warp threads WP-7 are arranged.

Sequentially, 1 ply of the sixth dark beige warp threads WP-6, 3 plies of the fifth warp threads WP-5, 1 ply of the sixth warp threads WP-6, and 2 plies of the fifth warp threads WP-5 are arranged. 1 ply of the sixth warp threads WP-6 and 1 ply of the fifth warp threads WP-5 are repeatedly arranged four times. 2 plies of the sixth warp threads WP-6, 1 ply of the fifth warp threads WP-5, 3 plies of the sixth warp threads WP-6, 1 ply of the fifth warp threads WP-5, and 6 plies of the sixth warp threads WP-6 are arranged.

Then, 1 ply of the seventh brown warp threads WP-7, 3 plies of the sixth warp threads WP-6, 1 ply of the seventh warp threads WP-7, and 2 plies of the sixth warp threads WP-6 are arranged. 1 ply of the seventh warp threads WP-7 and 1 ply of the sixth warp threads WP-6 are repeatedly arranged four times. 2 plies of the seventh warp threads WP-7, 1 ply of the sixth warp threads WP-6, 3 plies of the seventh warp threads WP-7, 1 ply of the sixth warp threads WP-6, and 7 plies of the seventh warp threads WP-7 are arranged.

Then, 1 ply of the eighth dark brown warp threads WP-8, 3 plies of the seventh warp threads WP-7, 1 ply of the eighth warp threads WP-8, and 2 plies of the seventh warp threads WP-7 are arranged. 1 ply of the eighth warp threads WP-8 and 1 ply of the seventh warp threads WP-7 are repeatedly arranged four times. 2 plies of the eighth warp threads WP-8, 1 ply of the seventh warp threads WP-7, 3 plies of eighth warp threads WP-8, 1 ply of the seventh warp threads WP-7, and 7 plies of the eighth warp threads WP-8 are arranged.

Then, 1 ply of the seventh warp threads WP-7, 3 plies of the eight warp threads WP-8, 1 ply of the seventh warp threads WP-7, and 2 plies of the eighth warp threads WP-8 are arranged. 1 ply of the eighth warp threads WP-8 and 1 ply of the seventh warp threads WP-7 are repeatedly arranged four times. 2 plies of the eighth warp threads WP-8, 1 ply of the seventh warp threads WP-7, 3 plies of eighth warp threads WP-8, 1 ply of the seventh warp threads WP-7, and 6 plies of the eighth warp threads WP-8 are arranged.

1 ply of the sixth warp threads WP-6, 3 plies of the seventh warp threads WP-7, 1 ply of the sixth warp threads WP-6, and 2 plies of the seventh warp threads WP-7 are arranged. 1 ply of the sixth warp threads WP-6 and 1 ply of the seventh warp threads WP-7 are repeatedly arranged four times. 2 plies of the sixth warp threads WP-6, 1 ply of the seventh warp threads WP-7, 3 plies of the sixth warp threads WP-6, 1 ply of the seventh warp threads WP-7, and 7 plies of the sixth warp threads WP-6 are arranged.

Then, 1 ply of the fifth warp threads WP-5, 3 plies of the sixth warp threads WP-6, 1 ply of the fifth warp threads WP-5, and 2 plies of the sixth warp threads WP-6 are arranged. 1 ply of the fifth warp threads WP-5 and 1 ply of the sixth warp threads WP-6 are repeatedly arranged four times. 2 plies of the fifth warp threads WP-5, 1 ply of the sixth warp threads WP-6, 3 plies of the fifth warp threads WP-5, 1 ply of the sixth warp threads WP-6, and 6 plies of the fifth warp threads WP-5 are arranged.

Sequentially, 1 ply of the fourth warp threads WP-4, 3 plies of the fifth warp threads WP-5, 1 ply of the fourth warp threads WP-4, and 2 plies of the fifth warp threads WP-5 are arranged. 1 ply of the fourth warp threads WP-4 and 1 ply of the fifth warp threads WP-5 are repeatedly arranged four times. 2 plies of the fourth warp threads WP-4, 1 ply of the fifth warp threads WP-5, 3 plies of the fourth warp threads WP-4, 1 ply of the fifth warp threads WP-5, and 7 plies of the fourth warp threads WP-4 are arranged.

1 ply of the third warp threads WP-3, 3 plies of the fourth warp threads WP-4, 1 ply of the third warp threads WP-3, and 2 plies of the fourth warp threads WP-4 are arranged. 1 ply of the third warp threads WP-3 and 1 ply of the fourth warp threads WP-4 are repeatedly arranged four times. 2 plies of the third warp threads WP-3, 1 ply of the fourth warp threads WP-4, 3 plies of the third warp threads WP-3, 1 ply of the fourth warp threads WP-4, and 6 plies of the fifth warp threads WP-7 are arranged.

1 ply of the second warp threads WP-2, 3 plies of the third warp threads WP-3, 1 ply of the second warp threads WP-2, and 2 plies of the warp threads WP-3 are arranged. 1 ply of the second warp threads WP-2 and 1 ply of the third warp threads WP-3 are repeatedly arranged four times. 2 plies of the second warp threads WP-2, 1 ply of the third warp threads WP-3, 3 plies of the second warp threads WP-2, 1 ply of the third warp threads WP-3, and 7 plies of the second warp threads WP-2 are arranged.

Then, 1 ply of the first warp threads WP-1, 3 plies of the second warp threads WP-2, 1 ply of the first warp threads WP-1, and 2 plies of the second warp threads WP-1 are arranged. 1 ply of the second warp threads WP-2 and 1 ply of the first warp threads WP-1 are repeatedly arranged four times. 2 plies of the second warp threads WP-2, 1 ply of the first warp threads WP-1, 3 plies of the second warp threads WP-2, 1 ply of the warp threads WP-1, and 1 ply of the second warp threads WP-2 are arranged.

As described above, 400 plies of the warp threads WP, which include 29 plies of the first darker khaki warp threads WP-1, 57 plies of the second dark khaki warp threads WP-2, 57 plies of the third khaki warp threads WP-3, 57 plies of the fourth light khaki warp threads WP-4, 57 plies of the fifth light green warp threads WP-5, 57 plies of the sixth dark beige warp threads WP-6, 57 plies of the seventh brown warp threads WP-7, and 29 plies of the eighth dark brown warp threads WP-8, constitute one color cycle. The warp threads WP are repeatedly arranged with the colors cycle. The repeatedly arranged warp threads WP are wound onto a warp beam. The warp beam is mounted at the jacquard weaving machine.

In terms of the arrangement of the warp threads WP, the colors are gradually arranged from darker khaki to khaki. Then, the colors are gradually arranged from light beige to dark brown. And then, the colors are arranged from dark brown to light beige. Sequentially, the colors are gradually arranged from light khaki to dark khaki. The colors of the warp threads WP are repeatedly arranged with the above color cycle.

In colors of the weft threads WT, first weft threads WT-1 are darker khaki, second weft threads WT-2 are dark khaki, third weft threads WT-3 are khaki, fourth weft threads WT-4 are light khaki, fifth weft threads WT-5 are light green, sixth weft threads WT-6 are dark beige, seventh weft threads WT-7 are brown, and eighth weft threads WT-8 are dark brown. One color arrangement cycle of the weft threads WT is 448 plies. Hereinafter, arrangement of the weft threads WT will be described below (see FIG. 14).

That is, 8 plies of the first darker khaki weft threads WT-1, 1 ply of the second dark khaki weft threads WT-2, 3 plies of the first weft threads WT-1, 1 ply of the second weft threads WT-1, and 2 plies of the first weft threads WT-1 are arranged. 1 ply of the second weft threads WT-2 and 1 ply of the first weft threads WT-1 are repeatedly arranged five times. 2 plies of the second weft threads WT-2, 1 ply of the first weft threads WT-1, 3 plies of the second weft threads WT-2, 1 ply of the weft threads WT-1, and 8 plies of the second weft threads WT-2 are arranged.

Then, 1 ply of the third khaki weft threads WT-3, 3 plies of the second weft threads WT-2, 1 ply of the third weft threads WT-3, and 2 plies of the second weft threads WT are arranged. 1 ply of the third weft threads WT-3 and 1 ply of the second weft threads WT-2 are repeatedly arranged five times. 2 plies of the third weft threads WT-3, 1 ply of the second weft threads WT-2, 3 plies of the third weft threads WT-3, 1 ply of the second weft threads WT-2, and 8 plies of the weft threads WT-3 are arranged.

Sequentially, 1 ply of the fourth light khaki weft threads WT-4, 3 plies of the third weft threads WT-3, 1 ply of the fourth weft threads WT-4, and 2 plies of the weft threads WT-3 are arranged. 1 ply of the fourth weft threads WT-4 and 1 ply of the third weft threads WT-3 are repeatedly arranged five times. 2 plies of the fourth weft threads WT-4, 1 ply of the third weft threads WT-3, 3 plies of the fourth weft threads WT-4, 1 ply of the third weft threads WT-3, and 8 plies of the fourth weft threads WT-4 are arranged.

Then, 1 ply of the fifth light green weft threads WT-5, 3 plies of the fourth weft threads WT-4, 1 ply of the fifth weft threads WT-5, and 2 plies of the fourth weft threads WT-4 are arranged. 1 ply of the fifth weft threads WT-5 and 1 ply of the fourth weft threads WT-4 are repeatedly arranged five times. 2 plies of the fifth weft threads WT-5, 1 ply of the fourth weft threads WT-4, 3 plies of the fifth weft threads WT-5, 1 ply of the fourth weft threads WT-4, and 8 plies of the fifth weft threads WT-7 are arranged.

Sequentially, 1 ply of the sixth dark beige weft threads WT-6, 3 plies of the fifth weft threads WT-5, 1 ply of the sixth weft threads WT-6, and 2 plies of the fifth weft threads WT-5 are arranged. 1 ply of the sixth weft threads WT-6 and 1 ply of the fifth weft threads WT-5 are repeatedly arranged five times. 2 plies of the sixth weft threads WT-6, 1 ply of the fifth weft threads WT-5, 3 plies of the sixth weft threads WT-6, 1 ply of the fifth weft threads WT-5, and 8 plies of the sixth weft threads WT-6 are arranged.

Then, 1 ply of the seventh brown weft threads WT-7, 3 plies of the sixth weft threads WT-6, 1 ply of the seventh weft threads WT-7, and 2 plies of the sixth weft threads WT-6 are arranged. 1 ply of the seventh weft threads WT-7 and 1 ply of the sixth weft threads WT-6 are repeatedly arranged five times. 2 plies of the seventh weft threads WT-7, 1 ply of the sixth weft threads WT-6, 3 plies of the seventh weft threads WT-7, 1 ply of the sixth weft threads WT-6, and 8 plies of the seventh weft threads WT-7 are arranged.

Then, 1 ply of the eighth dark brown weft threads WT-8, 3 plies of the seventh weft threads WT-7, 1 ply of the eighth weft threads WT-8, and 2 plies of the seventh weft threads WT-7 are arranged. 1 ply of the eighth weft threads WT-8 and 1 ply of the seventh weft threads WT-7 are repeatedly arranged five times. 2 plies of the eighth weft threads WT-8, 1 ply of the seventh weft threads WT-7, 3 plies of eighth weft threads WT-8, 1 ply of the seventh weft threads WT-7, and 8 plies of the eighth weft threads WT-8 are arranged.

Then, 1 ply of the seventh weft threads WT-7, 3 plies of the eight weft threads WT-8, 1 ply of the seventh weft threads WT-7, and 2 plies of the eighth weft threads WT-8 are arranged. 1 ply of the seventh weft threads WT-7 and 1 ply of the eighth weft threads WT-8 are repeatedly arranged five times. 2 plies of the seventh weft threads WT-7, 1 ply of the eighth weft threads WT-8, 3 plies of the seventh weft threads WT-7, 1 ply of the eighth weft threads WT-8, and 8 plies of the seventh weft threads WT-7 are arranged.

1 ply of the sixth weft threads WT-6, 3 plies of the seventh weft threads WT-7, 1 ply of the sixth weft threads WT-6, and 2 plies of the seventh weft threads WT-7 are arranged. 1 ply of the sixth weft threads WT-6 and 1 ply of the seventh weft threads WT-7 are repeatedly arranged five times. 2 plies of the sixth weft threads WT-6, 1 ply of the seventh weft threads WT-7, 3 plies of the sixth weft threads WT-6, 1 ply of the seventh weft threads WT-7, and 8 plies of the sixth weft threads WT-6 are arranged.

Then, 1 ply of the fifth weft threads WT-5, 3 plies of the sixth weft threads WT-6, 1 ply of the fifth weft threads WT-5, and 2 plies of the sixth weft threads WT-6 are arranged. 1 ply of the fifth weft threads WT-5 and 1 ply of the sixth weft threads WT-6 are repeatedly arranged five times. 2 plies of the fifth weft threads WT-5, 1 ply of the sixth weft threads WT-6, 3 plies of the fifth weft threads WT-5, 1 ply of the sixth weft threads WT-6, and 8 plies of the fifth weft threads WT-5 are arranged.

Sequentially, 1 ply of the fourth weft threads WT-4, 3 plies of the fifth weft threads WT-5, 1 ply of the fourth weft threads WT-4, and 2 plies of the fifth weft threads WT-5 are arranged. 1 ply of the fourth weft threads WT-4 and 1 ply of the fifth weft threads WT-5 are repeatedly arranged five times. 2 plies of the fourth weft threads WT-4, 1 ply of the fifth weft threads WT-5, 3 plies of the fourth weft threads WT-4, 1 ply of the fifth weft threads WT-5, and 8 plies of the fourth weft threads WT-4 are arranged.

1 ply of the third weft threads WT-3, 3 plies of the fourth weft threads WT-4, 1 ply of the third weft threads WT-3, and 2 plies of the fourth weft threads WT-4 are arranged. 1 ply of the third weft threads WT-3 and 1 ply of the fourth weft threads WT-4 are repeatedly arranged five times. 2 plies of the third weft threads WT-3, 1 ply of the fourth weft threads WT-4, 3 plies of the third weft threads WT-3, 1 ply of the fourth weft threads WT-4, and 8 plies of the fifth weft threads WT-7 are arranged.

1 ply of the second weft threads WT-2, 3 plies of the third weft threads WT-3, 1 ply of the second weft threads WT-2, and 2 plies of the weft threads WT-3 are arranged. 1 ply of the second weft threads WT-2 and 1 ply of the third weft threads WT-3 are repeatedly arranged five times. 2 plies of the second weft threads WT-2, 1 ply of the third weft threads WT-3, 3 plies of the second weft threads WT-2, 1 ply of the third weft threads WT-3, and 8 plies of the second weft threads WT-2 are arranged.

Then, 1 ply of the first weft threads WT-1, 3 plies of the second weft threads WT-2, 1 ply of the first weft threads WT-1, and 2 plies of the second weft threads WT-1 are arranged. 1 ply of the first weft threads WT-land 1 ply of the second weft threads WT-2 are repeatedly arranged five times. 2 plies of the first weft threads WT-1, 1 ply the second weft threads WT-2, 3 plies of the first weft threads WT-1, and 1 ply of the second weft threads WT-2 are arranged.

As described above, 448 plies of the weft threads WT, which include 32 plies of the first darker khaki weft threads WT-1, 64 plies of the second dark khaki weft threads WT-2, 64 plies of the third khaki weft threads WT-3, 64 plies of the fourth light khaki weft threads WT-4, 64 plies of the fifth light green weft threads WT-5, 64 plies of the sixth dark beige weft threads WT-6, 64 plies of the seventh brown weft threads WT-7, and 32 plies of the eighth dark brown weft threads WT-8, form one cycle. The weft threads WT of the cycle are inserted between the opened weft threads WT in arranged order. The cycle is repeated to weave the camouflage clothing 10.

Figure 10:
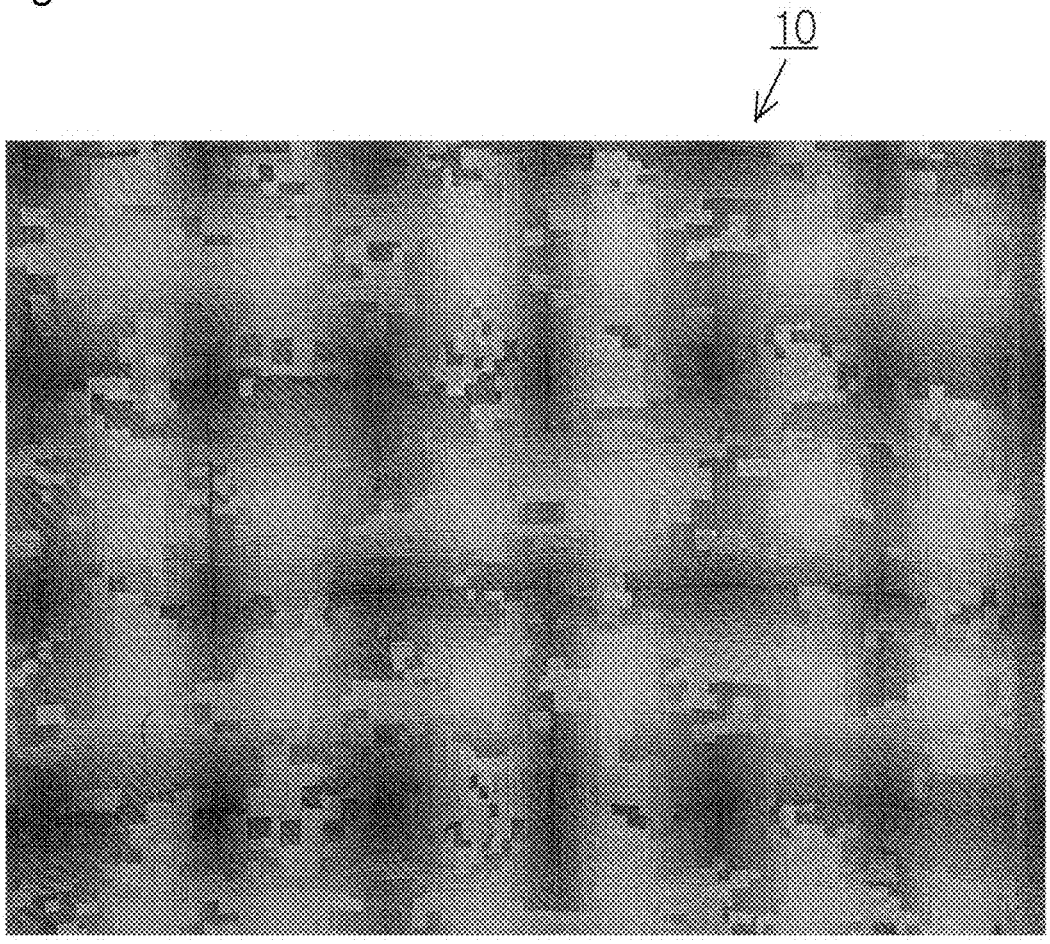
FIG. 10 is a picture of camouflage clothing according to still another embodiment of the present invention.
Figure 11:
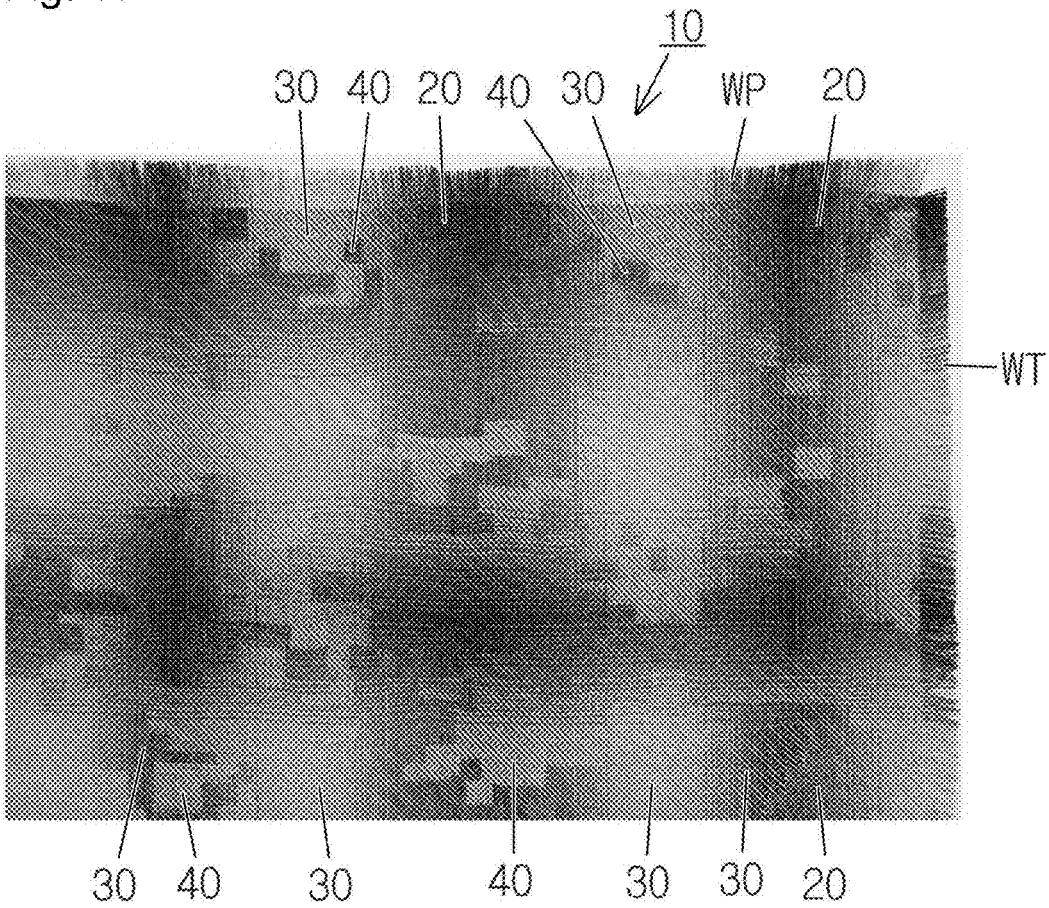
FIG. 11 is an enlarged picture of FIG. 10.

As illustrated in FIGS. 10 and 11, the camouflage clothing 10 includes an alternate pattern 20 woven by 1/1 plain weave 21, a first pattern 30 woven by 3/1 warp twill weave 31, and a second pattern 40 woven by 1/3 weft twill weave 41.

Accordingly, since the camouflage clothing 10 include the first pattern 30 woven by the warp twill weave 31 and the second pattern 40 woven by the weft twill weave 41 as well as the alternate pattern 20 woven by plain weave 21, various three-dimensional patterns are formed in the camouflage clothing 10. As a result, the 8-colored warp threads WP and the 8-colored weft threads WT are gradationally arranged such that a delicate checked pattern is displayed. Therefore, the camouflage clothing 10 having high camouflaging effect may be obtained.

In the fourth embodiment, since the warp and weft threads WP and WT includes the first darker khaki warp and weft threads WP-1 and WT-1, the second dark khaki warp and weft threads WP-2 and WT-2, the third khaki warp and weft threads WP-3 and WT-3, the fourth light khaki warp and weft threads WP-4 and WT-4, the fifth light green warp and weft threads WP-5 and WT-5, the sixth dark beige warp and weft threads WP-6 and WT-6, the seventh brown warp and weft threads WP-7 and WT-7, and the eighth dark brown warp and weft threads WP-8 and WT-8, as illustrated in FIG. 10, khaki and brown mingle in the woven camouflage clothing 10. Thereby, the camouflage clothing 10 may have camouflaging effect in areas with little wood or in winter after the leaves fall.

Fifth Embodiment

Figure 12:
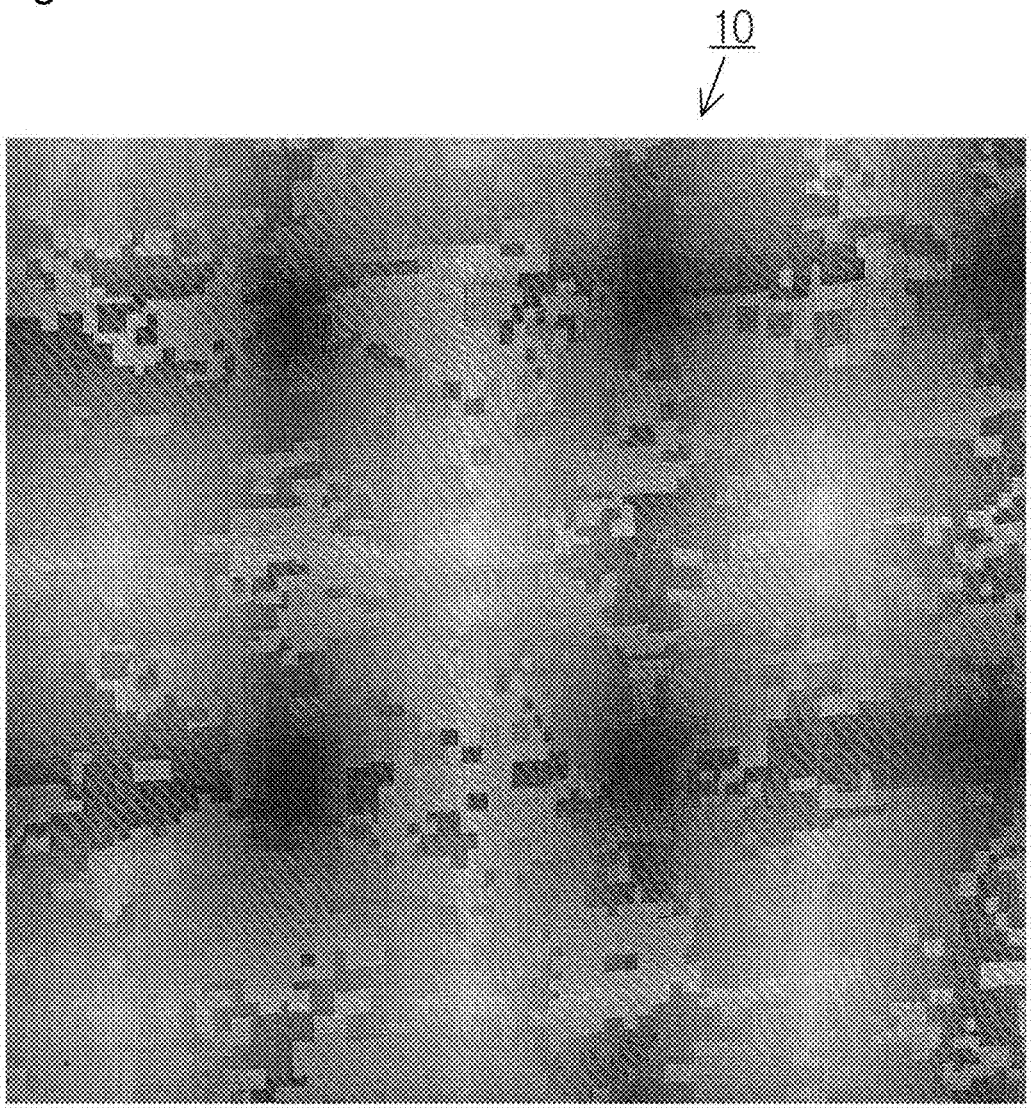
FIG. 12 is a picture of camouflage clothing according to still another embodiment of the present invention.
Figure 13:
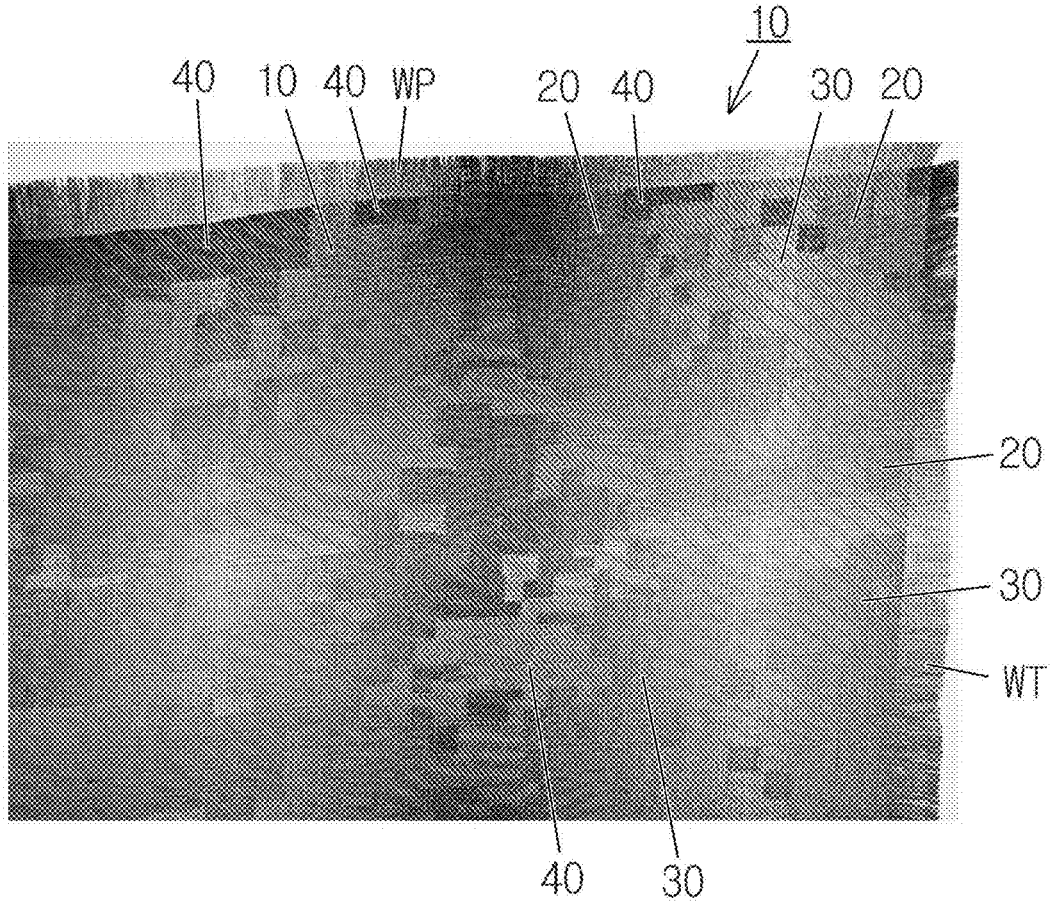
FIG. 13 is an enlarged picture of FIG. 12.

The fifth embodiment is based on a digital pattern. As described in the fourth embodiment, dyed warp threads WP having8 different colors and dyed weft threads WT having 8 different colors are arranged. However, to achieve camouflaging effect in spring and summer with luxuriance of verdant plants or in densely wooded areas, an arrangement of the warp threads WP and the weft threads WT is changed to have a different gradation type so as to weave the camouflage clothing 10 having a delicate-colored checked pattern as illustrated in FIGS. 12 and 13. Threads used as the warp threads and the weft threads are made of 40/2 twisted threads including polyester and rayon (65:35). A density of the warp threads WP is 83T and a density of the weft threads WT is 72T.

However, the thickness of the threads or the densities of the warp and weft threads WP and WT may be changed based on a weaving design.

In the fifth embodiment, the arrangement of the warp and weft threads WP and WT is the same as that of the fourth embodiment but the colors of the warp and weft threads WP and WT are different to have camouflaging effect at in densely wooded areas.

Figure 16:
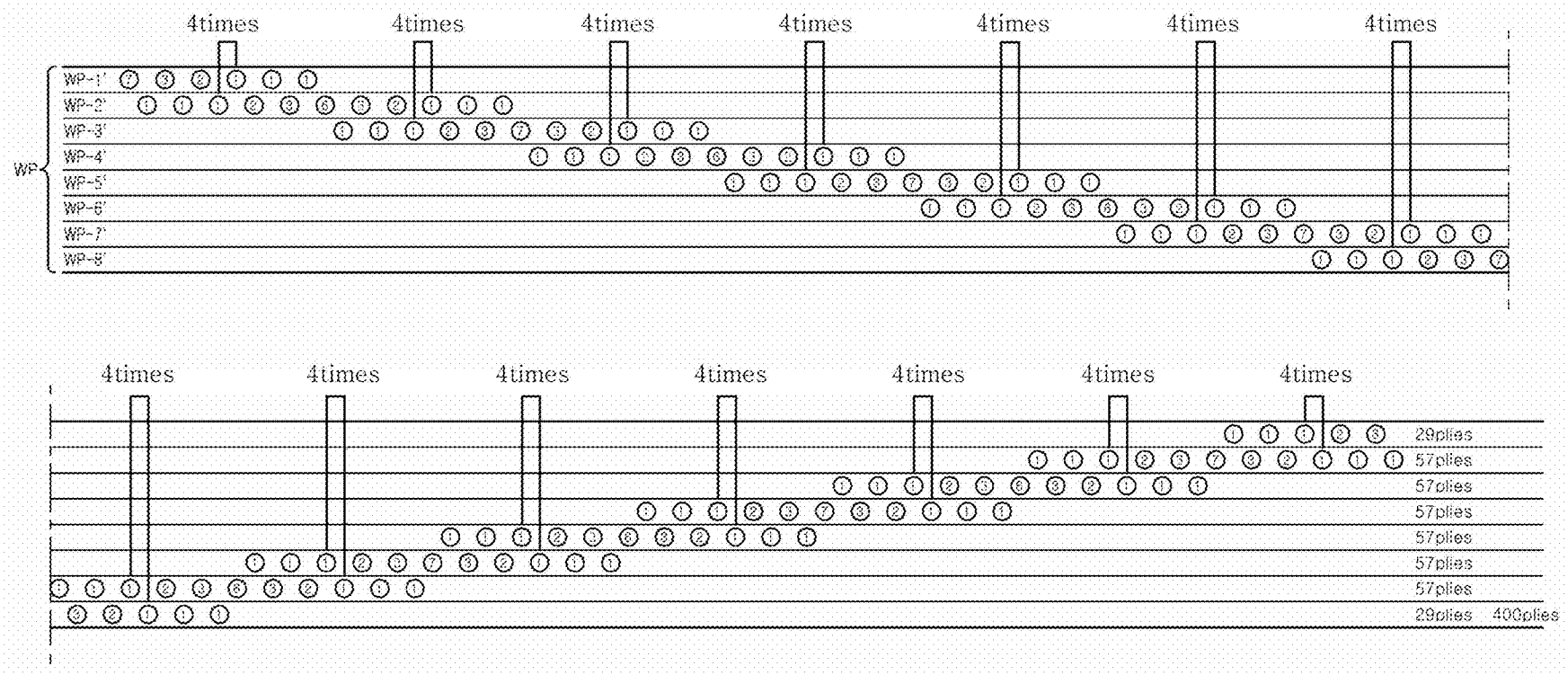
FIG. 16 is an order of arrangement of warp threads for weaving the camouflage clothing of FIG. 12.

In colors of the warp threads WP, first warp threads WP-1' are darkest green, second warp threads WP-2' are darker green, third warp threads WP-3' are dark green, fourth warp threads WP-4' are green, fifth warp threads WP-5' are light green, sixth warp threads WP-6' are dark yellow-green, seventh warp threads WP-7' are yellow-green, and eighth warp threads WP-8' are light yellow-green. One color arrangement cycle of the warp threads WP is 400 plies (see FIG. 16). The warp threads WP are repeatedly arranged with the colors arrangement cycle and are wound onto a warp beam. The warp beam is mounted at the jacquard weaving machine.

In terms of the arrangement of the warp threads WP, the colors are gradually arranged from darkest green to green. The colors are gradually arranged from dark yellow-green to light yellow-green. The colors of the warp threads WP are repeatedly arranged with the above color cycle.

Figure 17:
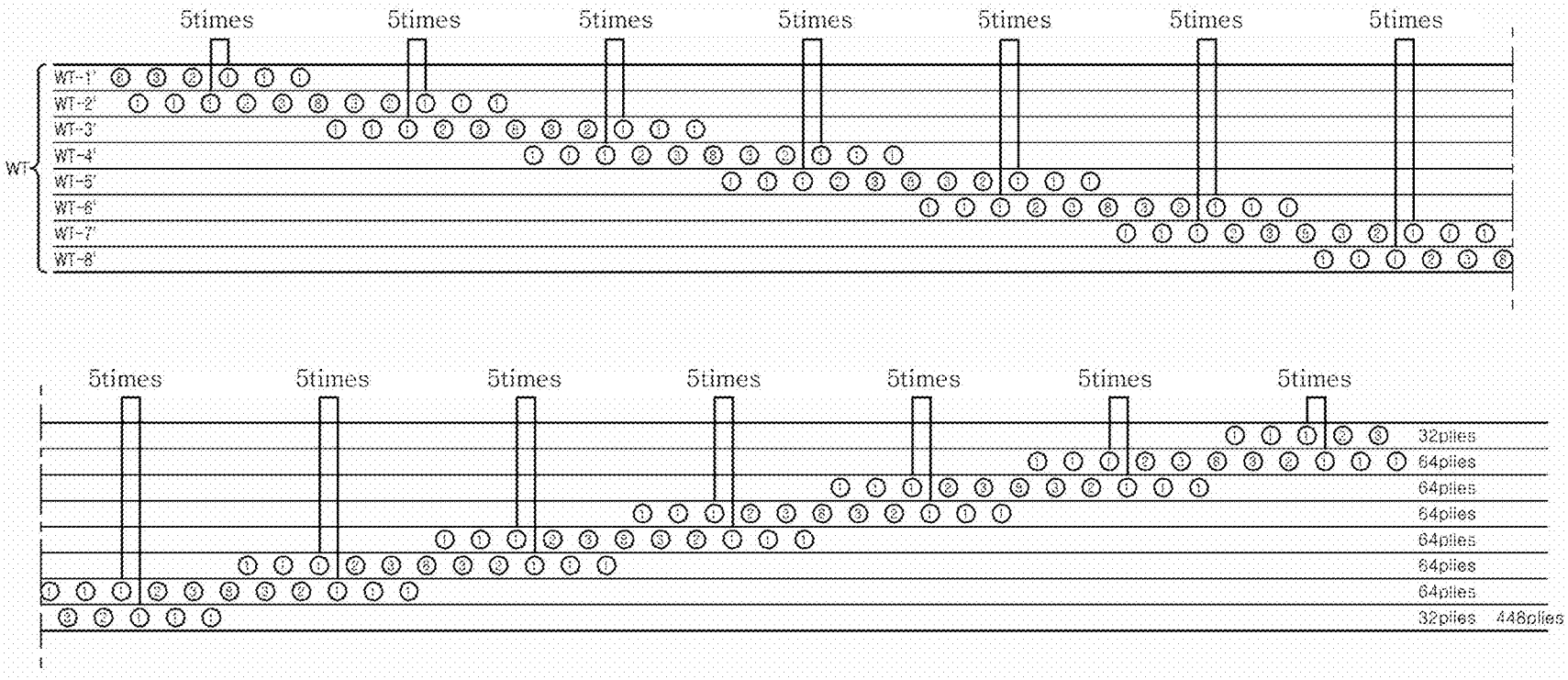
FIG. 17 is an order of arrangement of weft threads for weaving the camouflage clothing of FIG. 12.
Figure 18:
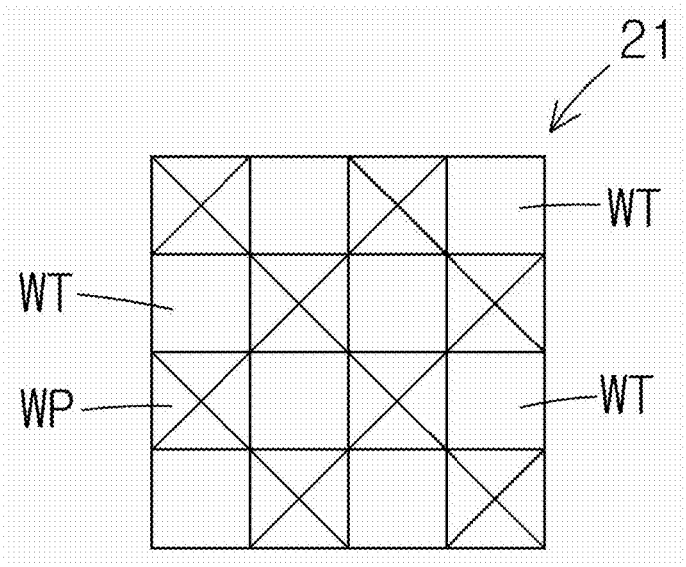
FIG. 18 is a plain weave contexture used when an alternative pattern is woven in the camouflage clothing according to the present invention.
Figure 19:
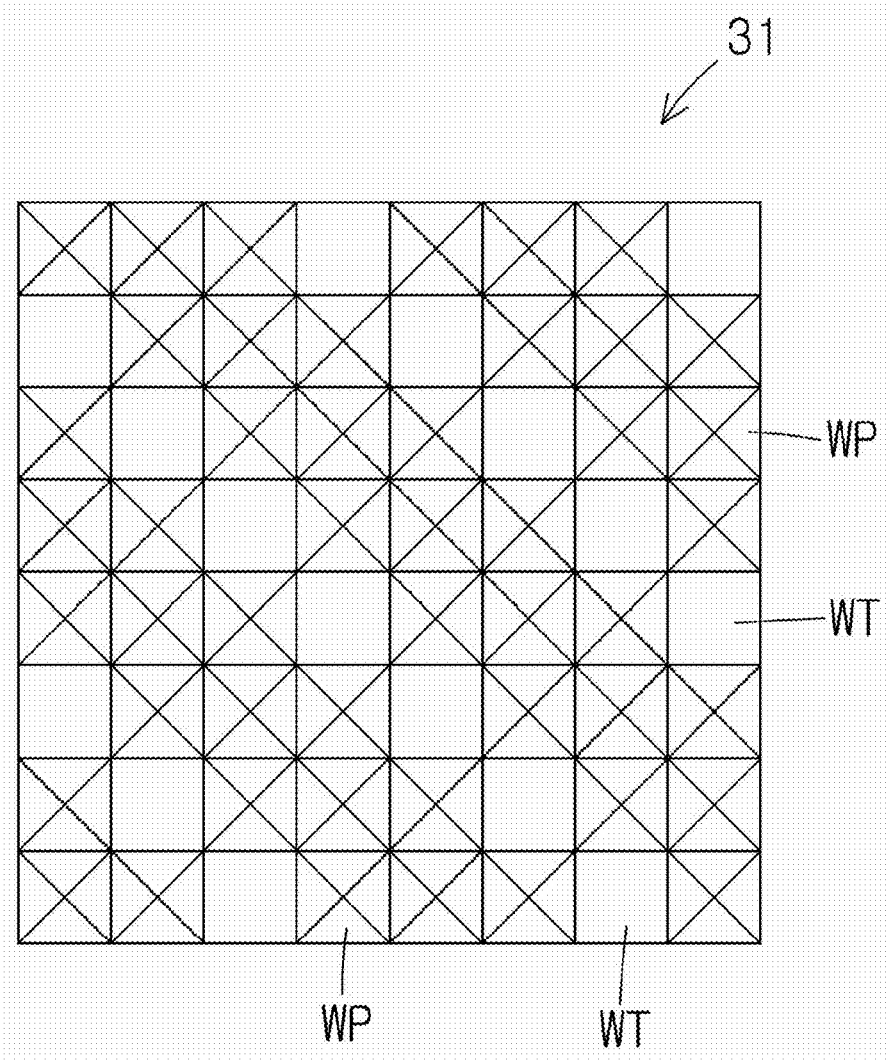
FIG. 19 is a warp twill weave contexture used when a first pattern is woven in camouflage clothing according to the present invention.
Figure 20:
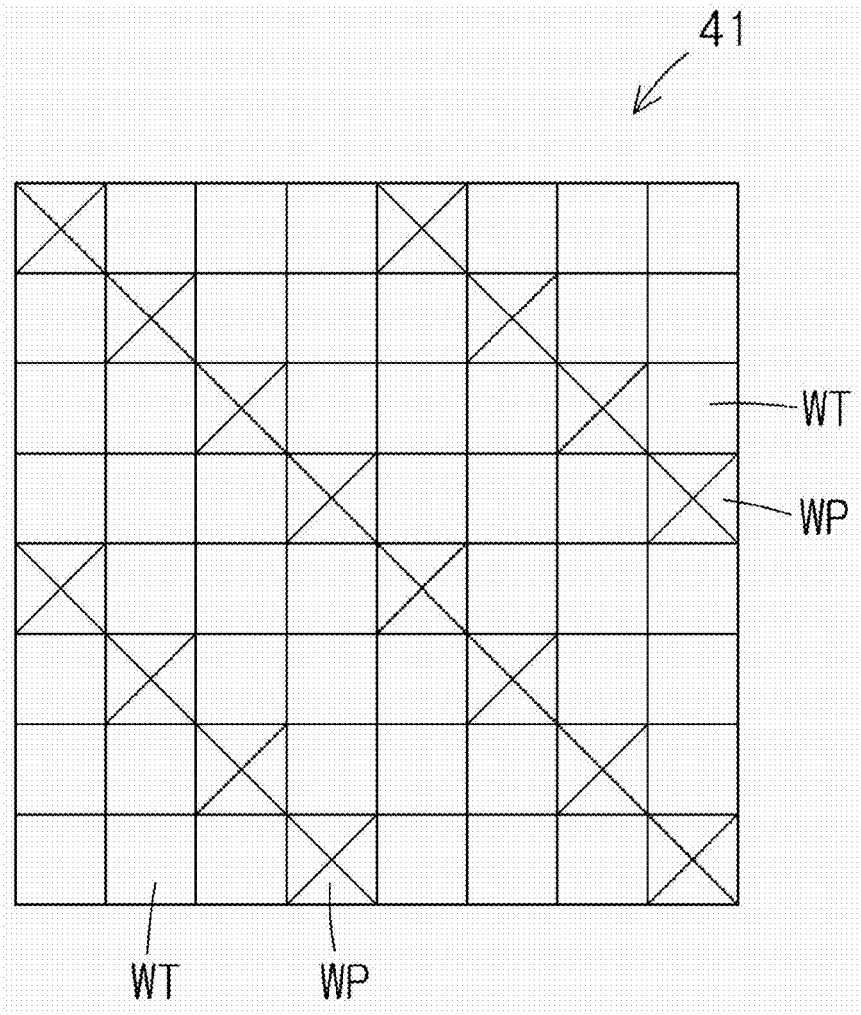
FIG. 20 is a weft twill weave contexture used when a second pattern is woven in camouflage clothing according to the present invention.

In colors of the weft threads WT, first weft threads WT-1' are darkest green, second weft threads WT-2' are darker green, third weft threads WT-3' are dark green, fourth weft threads WT-4' are green, fifth weft threads WT-5' are light green, sixth weft threads WT-6' are dark yellow-green, seventh weft threads WT-7' are yellow-green, and eighth weft threads WT-8' are light yellow-green. One color arrangement cycle of the weft threads WT is 448 plies (see FIG. 17).

The weft threads WT are inserted between the opened warp threads WP in arranged order to form the arrangement of the weft threads WT. One cycle is completed by insertion of the 448 plies of the weft threads WT. Thereby, the camouflage clothing 10 is woven by repetition of the insertion cycle of 448 plies of the weft threads WT.

The order of the warp and weft threads WP and WT arranged by color is the same as that of the fourth embodiment.

As illustrated in FIGS. 12 and 13, the camouflage clothing 10 described in the fifth embodiment includes an alternate pattern 20 woven by 1/1 plain weave 21, a first pattern 30 woven by 3/1 warp twill weave 31, and a second pattern 40 woven by 1/3 weft twill weave 41.

According to the present invention, the threads used as the warp threads WP may be arranged to have various colors instead of one arrangement cycle in which the colors arrangement is repeated. The weft threads WT may have 12 different colors. Thereby, the camouflage clothing may be woven to have high camouflaging effect depending on various climate, localities and geographical features.

Figure 21:
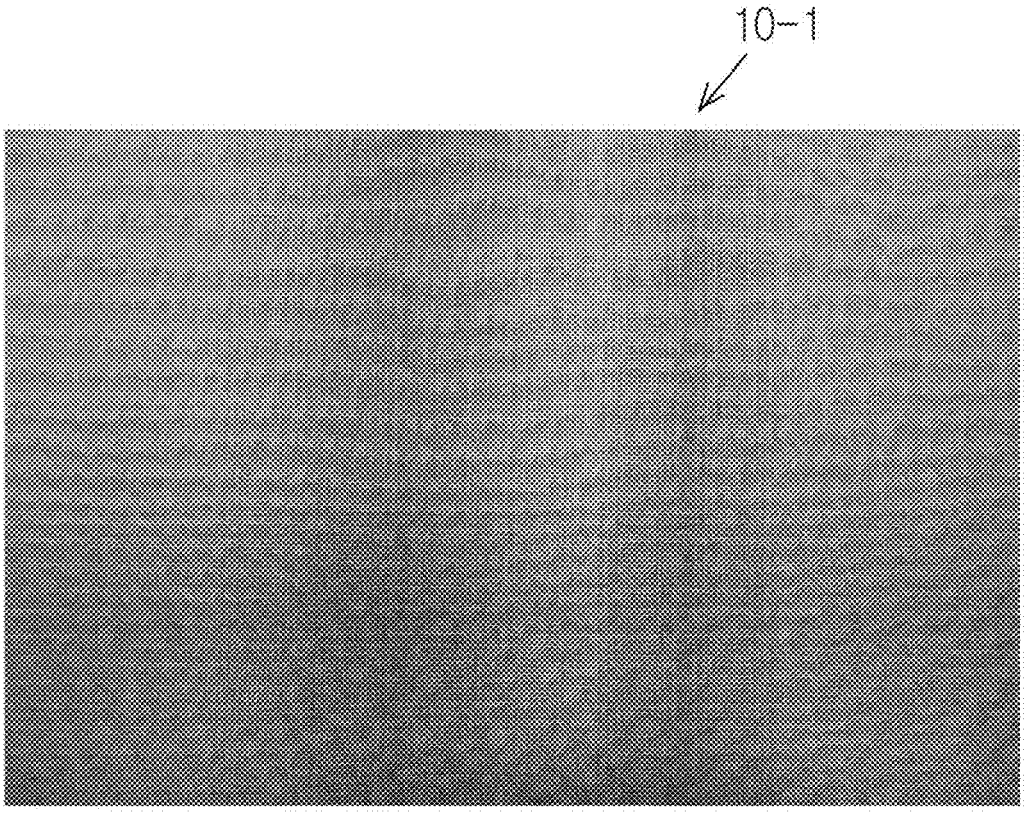
FIG. 21 is a picture of camouflage clothing woven by a plain weave according to the present invention.
Figure 22:
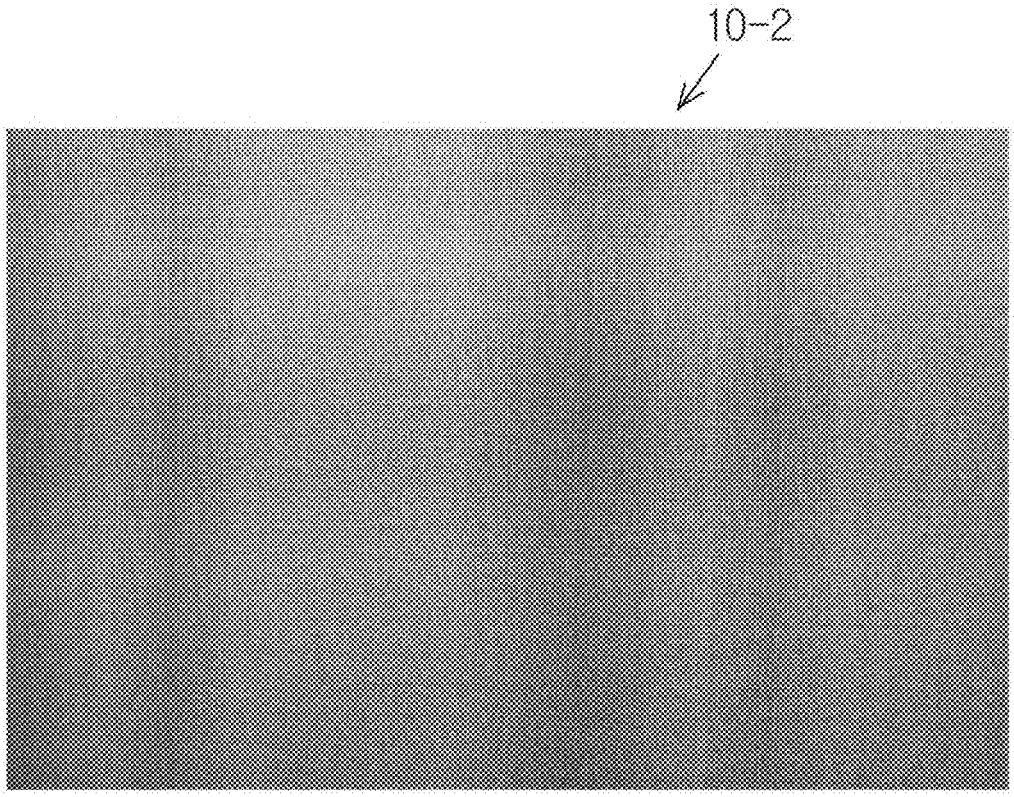
FIG. 22 is a picture of camouflage clothing woven by a rip stop weave according to the present invention.
Figure 23:
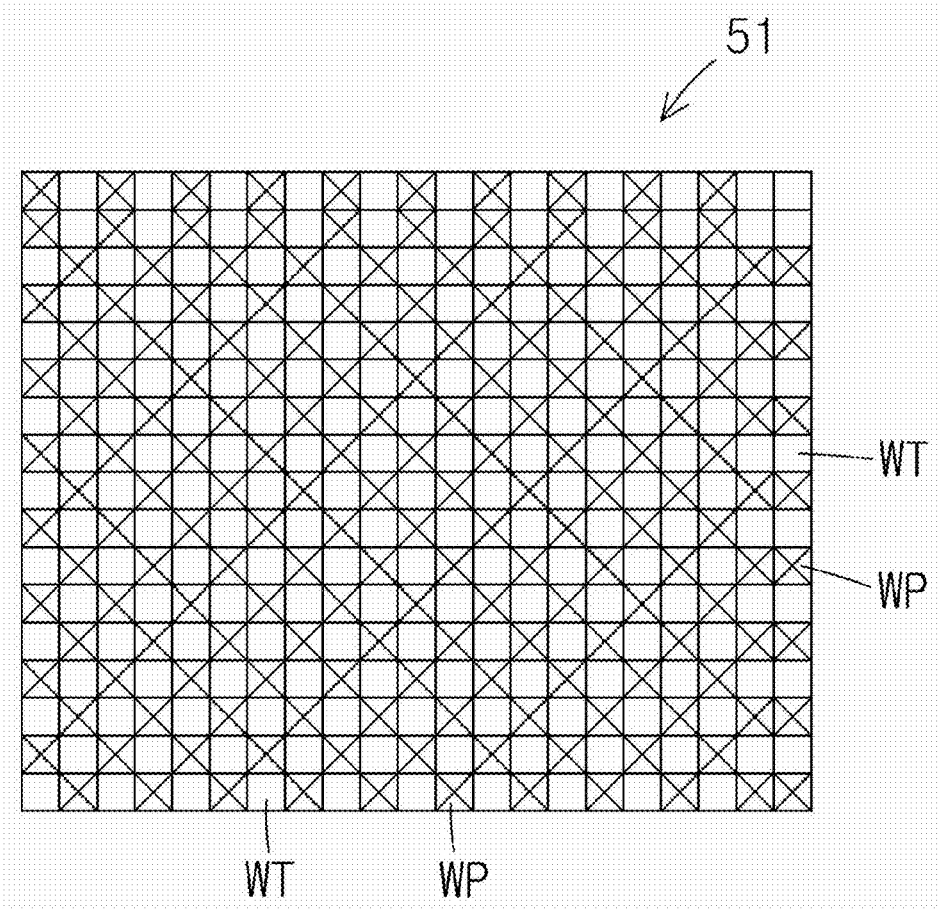
FIG. 23 is the rip stop weave contexture used when the camouflage clothing of FIG. 22 is woven according to the present invention.

In terms of weaving the camouflage clothing 10 according to the present invention, the warp and weft threads WP and WT are arranged as described in each embodiment. As illustrated in FIG. 21, camouflage clothing 10-1 may be woven with plain weave by a dobby weaving machine. As illustrated in FIG. 22, camouflage clothing 10-2 may be woven with rip-stop weave, which is a variation of plain weave by the dobby weaving machine.

As described above, the present invention discloses weaving the camouflage clothing. The dyed threads with various colors are used as the warp threads and the weft threads. The warp threads and the weft threads are gradationally arranged and then are woven by the jacquard weaving machine. Therefore, a delicate-colored checked pattern is formed by a gradation arrangement and the three-dimensional camouflage pattern occurs by the jacquard weaving machine. The camouflage clothing may be woven depending on localities to improve clothing functionality and camouflaging effect, which is an important function as the military uniform.

As apparent from the above description, the camouflage clothing is formed by dyeing threads i.e. row material, using the dyed threads as warp threads and weft threads, and weaving the camouflage clothing using a jacquard weaving machine. Herein, the warp threads and the weft threads are gradationally arranged to form a delicate-colored checked pattern while a three-dimensional pattern is displayed by the jacquard weaving machine. Thereby, the camouflage clothing satisfies clothing functionality, aesthetics, and camouflaging effect, which is an important function for military uniforms while being economical.

What is claimed is:

1. A method of camouflage clothing woven using dyed threads and a jacquard weaving machine comprising:

arranging 5 colored warp threads and 5 colored weft threads to weave the camouflage clothing using the jacquard machine, wherein the warp threads include first dark green warp threads, second green warp threads, third light green warp threads, fourth brown warp threads, and fifth beige warp threads, 400 plies of the warp threads form one color cycle, and the warp threads are repeatedly arranged with the colors cycle, 10 plies of the first dark green warp threads, 1 ply of the second green warp threads, and 3 plies of the first dark green warp threads are arranged, 1 ply of the second warp threads and 2 plies of the first warp threads are repeatedly arranged twice, 1 ply of the second warp threads and 1 ply of the first warp threads are repeatedly arranged five times, 2 plies of the second warp threads and 1 ply of the first warp threads are repeatedly arranged twice, 3 plies of the second warp threads and 1 ply of the first warp threads, and 10 plies of the second warp threads are arranged, 1 ply of the third light green warp threads and 3 plies of the second warp threads are arranged, 1 ply of the third warp threads and 2 plies of the second warp threads are repeatedly arranged twice, 1 ply of the third warp threads and 1 ply of the second warp threads are repeatedly arranged five times, 2 plies of the third warp threads and 1 ply of the second warp threads are repeatedly arranged twice, 3 plies of the warp threads, 1 ply of the second warp threads, 10 plies of the third warp threads, 1 ply of the second warp threads, and 3 plies of the warp threads are arranged, 1 ply of the second warp threads and 2 plies of the third warp threads are repeatedly arranged twice, 1 ply of the warp threads and 1 ply of the third warp threads are repeatedly arranged five times, 2 plies of the second warp threads and 1 ply of the third warp threads are repeatedly arranged twice, 3 plies of the second warp threads, 1 ply of the third warp threads, and 10 plies of the second warp threads are arranged, 1 ply of the fourth brown warp threads and 3 plies of the second warp threads are arranged, 1 ply of the fourth warp threads and 2 plies of the second warp threads are repeatedly arranged twice, 1 ply of the fourth warp threads and 1 ply of the second warp threads are repeatedly arranged five times, 2 plies of the fourth warp threads and 1 ply of the second warp threads are repeatedly arranged twice, 3 plies of the fourth warp threads, 1 ply of the second warp threads, 10 plies of the fourth warp threads, 1 ply of the second warp threads, and 3 plies of the fourth warp threads are arranged, 1 ply of the second warp threads and 2 plies of the fourth warp threads are repeatedly arranged twice, 1 ply of the second warp threads and 1 ply of the fourth warp threads are repeatedly arranged five times, 2 plies of the second warp threads and 1 ply of the fourth warp threads are repeated arranged twice, 3 plies of the second warp threads, 1 ply of the fourth warp threads, 10 plies of the second warp threads, 1 ply of the third warp threads, and 3 plies of the second warp threads are arranged, 1 ply of the third warp threads and 2 plies of the second warp threads are repeatedly arranged twice, 1 ply of the third warp threads and 1 ply of the second warp threads are repeatedly arranged five times, 2 plies of the third warp threads and 1 ply of the second warp threads are repeatedly arranged twice, 2 plies of the third warp threads and 1 ply of the second warp threads are repeatedly arranged twice, 3 plies of the third warp threads, 1 ply of the second warp threads, and 10 plies of the third warp threads are arranged, 1 ply of the fifth beige warp threads and 3 plies of the third warp threads are arranged, 1 ply of the fifth warp threads and 2 plies of the third warp threads are repeatedly arranged twice, 1 ply of the fifth warp threads and 1 ply of the third warp threads are repeatedly arranged five times, 2 plies of the fifth warp threads and 1 ply of the third warp threads are repeatedly arranged twice, 3 plies of the fifth warp threads, 1 ply of the third warp threads, 10 plies of the fifth warp threads, 1 ply of the third warp threads, and 3 plies of the fifth warp threads are arranged, 1 ply of the third warp threads and 2 plies of the fifth warp threads are repeated arranged twice, 1 ply of the third warp threads and 1 ply of the fifth warp threads are repeatedly arranged five times, 2 plies of the third warp threads and 1 ply of the fifth warp threads are repeatedly arranged twice, 3 plies of the third warp threads, 1 ply of the fifth warp threads, 10 plies of the third warp threads, 1 ply of the second warp threads, and 3 plies of the third warp threads are arranged, 1 ply of the second warp threads and 2 plies of the third warp threads are repeatedly arranged twice, 1 ply of the second warp threads and 1 ply of the third warp threads are repeatedly arranged five times, 2 plies of the second warp threads and 1 ply of the third warp threads are repeatedly arranged twice, 3 plies of the second warp threads, 1 ply of the third warp threads, 10 plies of the second warp threads, 1 ply of the first warp threads, and 3 plies of the second warp threads are arranged, 1 ply of the first warp threads and 2 plies of the second warp threads are repeatedly arranged twice, 1 ply of the first warp threads and 1 ply of the second warp threads are repeatedly arranged five times, 2 plies of the first warp threads and 1 ply of the second warp threads are repeatedly arranged twice, and 3 plies of the first warp threads and 1 ply of the second warp threads are arranged, 400 plies of the warp threads, which include 40 plies of the first dark green warp threads, 160 plies of the second green warp threads, 120 plies of the third light green warp threads, 40 plies of the fourth brown warp threads, and 40 plies of the fifth beige warp threads, form one color cycle, the warp threads are repeatedly arranged with the colors cycle, and the repeatedly arranged warp threads are wound onto a warp beam, and in the arrangement of the weft threads, 10 plies of the first dark green weft threads, 1 ply of the second green weft threads, and 3 plies of the first dark green weft threads are arranged, 1 ply of the second weft threads and 2 plies of the first weft threads are repeatedly arranged twice, 1 ply of the second weft threads and 1 ply of the first weft threads are repeatedly arranged five times, 2 plies of the second weft threads and 1 ply of the first weft threads are repeatedly arranged twice, 3 plies of the second weft threads and 1 ply of the first weft threads, and 10 plies of the second weft threads are arranged, 1 ply of the third light green weft threads and 3 plies of the second weft threads are arranged, 1 ply of the third weft threads and 2 plies of the second weft threads are repeatedly arranged twice, 1 ply of the third weft threads and 1 ply of the second weft threads are repeatedly arranged five times, 2 plies of the third weft threads and 1 ply of the second weft threads are repeatedly arranged twice, 3 plies of the weft threads, 1 ply of the second weft threads, 10 plies of the third weft threads, 1 ply of the second weft threads, and 3 plies of the weft threads are arranged, 1 ply of the second weft threads and 2 plies of the third weft threads are repeatedly arranged twice, 1 ply of the weft threads and 1 ply of the third weft threads are repeatedly arranged five times, 2 plies of the second weft threads and 1 ply of the third weft threads are repeatedly arranged twice, 3 plies of the second weft threads, 1 ply of the third weft threads, and 10 plies of the second weft threads are arranged, 1 ply of the fourth brown weft threads and 3 plies of the second weft threads are arranged, 1 ply of the fourth weft threads and 2 plies of the second weft threads are repeatedly arranged twice, 1 ply of the fourth weft threads and 1 ply of the second weft threads are repeatedly arranged five times, 2 plies of the fourth weft threads and 1 ply of the second weft threads are repeatedly arranged twice, 3 plies of the fourth weft threads, 1 ply of the second weft threads, 10 plies of the fourth weft threads, 1 ply of the second weft threads, and 3 plies of the fourth weft threads are arranged, 1 ply of the second weft threads and 2 plies of the fourth weft threads are repeatedly arranged twice, 1 ply of the second weft threads and 1 ply of the fourth weft threads are repeatedly arranged five times, 2 plies of the second weft threads and 1 ply of the fourth weft threads are repeated arranged twice, 3 plies of the second weft threads, 1 ply of the fourth weft threads, 10 plies of the second weft threads, 1 ply of the third weft threads, and 3 plies of the second weft threads are arranged, 1 ply of the third weft threads and 2 plies of the second weft threads are repeatedly arranged twice, 1 ply of the third weft threads and 1 ply of the second weft threads are repeatedly arranged five times, 2 plies of the third weft threads and 1 ply of the second weft threads are repeatedly arranged twice, 2 plies of the third weft threads and 1 ply of the second weft threads are repeatedly arranged twice, 3 plies of the third weft threads, 1 ply of the second weft threads, and 10 plies of the third weft threads are arranged, 1 ply of the fifth beige weft threads and 3 plies of the third weft threads are arranged, 1 ply of the fifth weft threads and 2 plies of the third weft threads are repeatedly arranged twice, 1 ply of the fifth weft threads and 1 ply of the third weft threads are repeatedly arranged five times, 2 plies of the fifth weft threads and 1 ply of the third weft threads are repeatedly arranged twice, 3 plies of the fifth weft threads, 1 ply of the third weft threads, 10 plies of the fifth weft threads, 1 ply of the third weft threads, and 3 plies of the fifth weft threads are arranged, 1 ply of the third weft threads and 2 plies of the fifth weft threads are repeated arranged twice, 1 ply of the third weft threads and 1 ply of the fifth weft threads are repeatedly arranged five times, 2 plies of the third weft threads and 1 ply of the fifth weft threads are repeatedly arranged twice, 3 plies of the third weft threads, 1 ply of the fifth weft threads, 10 plies of the third weft threads, 1 ply of the second weft threads, and 3 plies of the third weft threads are arranged, 1 ply of the second weft threads and 2 plies of the third weft threads are repeatedly arranged twice, 1 ply of the second weft threads and 1 ply of the third weft threads are repeatedly arranged five times, 2 plies of the second weft threads and 1 ply of the third weft threads are repeatedly arranged twice, 3 plies of the second weft threads, 1 ply of the third weft threads, 10 plies of the second weft threads, 1 ply of the first weft threads, and 3 plies of the second weft threads are arranged, 1 ply of the first weft threads and 2 plies of the second weft threads are repeatedly arranged twice, 1 ply of the first weft threads and 1 ply of the second weft threads are repeatedly arranged five times, 2 plies of the first weft threads and 1 ply of the second weft threads are repeatedly arranged twice, 3 plies of the first weft threads and 1 ply of the second weft threads are arranged, 400 plies of the weft threads, which include 40 plies of the first dark green weft threads, 160 plies of the second green weft threads, 120 plies of the third light green weft threads, 40 plies of the fourth brown weft threads, and 40 plies of the fifth beige weft threads, form one color cycle, the weft threads WT are repeatedly arranged with the colors cycle to form the camouflage clothing, and the camouflage clothing includes an alternate pattern woven by 1/1 plain weave, a first pattern woven by 3/1 warp twill weave, and a second pattern woven by 1/3 weft twill weave.

2. The method according to claim 1, wherein a part of the weft threads disposed at one side of the camouflage clothing is lengthy woven not to be perpendicular to the warp threads, and then the non-perpendicular weft threads is cut after weaving to clearly display the first pattern and the second pattern.

3. A method of camouflage clothing woven using dyed threads and a jacquard weaving machine comprising:

arranging 8 colored warp threads and 8 colored weft threads to weave the camouflage clothing using the jacquard machine, wherein the warp threads include first dark darker khaki warp threads, second dark khaki warp threads, third khaki warp threads, fourth light khaki warp threads, fifth light green warp threads, sixth dark beige warp threads, seventh brown warp threads, and eighth dark beige warp threads, 400 plies of the warp threads form one color cycle, and the warp threads are repeatedly arranged with the colors cycle, and the repeatedly arranged warp threads are wound onto a warp beam, 7 plies of the first darker khaki warp threads, 1 ply of the second dark khaki warp threads, 3 plies of the first warp threads, 1 ply of the second warp threads, and 2 plies of the first warp threads are arranged, 1 ply of the second warp threads and 1 ply of the first warp threads are repeatedly arranged four times, 2 plies of the second warp threads, 1 ply of the first warp threads, 3 plies of the second warp threads, 1 ply of the first warp threads, and 6 plies of the second warp threads are arranged, 1 ply of the third khaki warp threads, 3 plies of the second warp threads, 1 ply of the third warp threads, and 2 plies of the second warp threads WP are arranged, 1 ply of the third warp threads and 1 ply of the second warp threads are repeatedly arranged four times, 2 plies of the third warp threads, 1 ply of the second warp threads, 3 plies of the third warp threads, 1 ply of the second warp threads, and 7 plies of the warp threads are arranged, 1 ply of the fourth light khaki warp threads, 3 plies of the third warp threads, 1 ply of the fourth warp threads, and 2 plies of the warp threads are arranged, 1 ply of the fourth warp threads and 1 ply of the third warp threads are repeatedly arranged four times, 2 plies of the fourth warp threads, 1 ply of the third warp threads, 3 plies of the fourth warp threads, 1 ply of the third warp threads, and 6 plies of the fourth warp threads are arranged, 1 ply of the fifth light green warp threads, 3 plies of the fourth warp threads, 1 ply of the fifth warp threads, and 2 plies of the fourth warp threads are arranged, 1 ply of the fifth warp threads and 1 ply of the fourth warp threads are repeatedly arranged four times, 2 plies of the fifth warp threads, 1 ply of the fourth warp threads, 3 plies of the fifth warp threads, 1 ply of the fourth warp threads, and 7 plies of the fifth warp threads are arranged, 1 ply of the sixth dark beige warp threads, 3 plies of the fifth warp threads, 1 ply of the sixth warp threads, and 2 plies of the fifth warp threads are arranged, 1 ply of the sixth warp threads and 1 ply of the fifth warp threads are repeatedly arranged four times, 2 plies of the sixth warp threads, 1 ply of the fifth warp threads, 3 plies of the sixth warp threads, 1 ply of the fifth warp threads, and 6 plies of the sixth warp threads are arranged, 1 ply of the seventh brown warp threads, 3 plies of the sixth warp threads, 1 ply of the seventh warp threads, and 2 plies of the sixth warp threads are arranged, 1 ply of the seventh warp threads and 1 ply of the sixth warp threads are repeatedly arranged four times, 2 plies of the seventh warp threads, 1 ply of the sixth warp threads, 3 plies of the seventh warp threads, 1 ply of the sixth warp threads, and 7 plies of the seventh warp threads are arranged, 1 ply of the eighth dark brown warp threads, 3 plies of the seventh warp threads, 1 ply of the eighth warp threads, and 2 plies of the seventh warp threads are arranged, 1 ply of the eighth warp threads and 1 ply of the seventh warp threads are repeatedly arranged four times, 2 plies of the eighth warp threads, 1 ply of the seventh warp threads, 3 plies of eighth warp threads, 1 ply of the seventh warp threads, and 7 plies of the eighth warp threads are arranged, 1 ply of the seventh warp threads, 3 plies of the eight warp threads, 1 ply of the seventh warp threads, and 2 plies of the eighth warp threads are arranged, 1 ply of the eighth warp threads and 1 ply of the seventh warp threads are repeatedly arranged four times, 2 plies of the eighth warp threads, 1 ply of the seventh warp threads, 3 plies of eighth warp threads, 1 ply of the seventh warp threads, and 6 plies of the eighth warp threads are arranged, 1 ply of the sixth warp threads, 3 plies of the seventh warp threads, 1 ply of the sixth warp threads, and 2 plies of the seventh warp threads are arranged, 1 ply of the sixth warp threads and 1 ply of the seventh warp threads are repeatedly arranged four times, 2 plies of the sixth warp threads, 1 ply of the seventh warp threads, 3 plies of the sixth warp threads, 1 ply of the seventh warp threads, and 7 plies of the sixth warp threads are arranged, 1 ply of the fifth warp threads, 3 plies of the sixth warp threads, 1 ply of the fifth warp threads, and 2 plies of the sixth warp threads are arranged, 1 ply of the fifth warp threads and 1 ply of the sixth warp threads are repeatedly arranged four times, 2 plies of the fifth warp threads, 1 ply of the sixth warp threads, 3 plies of the fifth warp threads, 1 ply of the sixth warp threads, and 6 plies of the fifth warp threads are arranged, 1 ply of the fourth warp threads, 3 plies of the fifth warp threads, 1 ply of the fourth warp threads, and 2 plies of the fifth warp threads are arranged, 1 ply of the fourth warp threads and 1 ply of the fifth warp threads are repeatedly arranged four times, 2 plies of the fourth warp threads, 1 ply of the fifth warp threads, 3 plies of the fourth warp threads, 1 ply of the fifth warp threads, and 7 plies of the fourth warp threads are arranged, 1 ply of the third warp threads, 3 plies of the fourth warp threads, 1 ply of the third warp threads, and 2 plies of the fourth warp threads are arranged, 1 ply of the third warp threads and 1 ply of the fourth warp threads are repeatedly arranged four times, 2 plies of the third warp threads, 1 ply of the fourth warp threads, 3 plies of the third warp threads, 1 ply of the fourth warp threads, and 6 plies of the fifth warp threads are arranged, 1 ply of the second warp threads, 3 plies of the third warp threads, 1 ply of the second warp threads, and 2 plies of the warp threads are arranged, 1 ply of the second warp threads and 1 ply of the third warp threads are repeatedly arranged four times, 2 plies of the second warp threads, 1 ply of the third warp threads, 3 plies of the second warp threads, 1 ply of the third warp threads, and 7 plies of the second warp threads are arranged, 1 ply of the first warp threads, 3 plies of the second warp threads, 1 ply of the first warp threads, and 2 plies of the second warp threads are arranged, 1 ply of the second warp threads and 1 ply of the first warp threads are repeatedly arranged four times, 2 plies of the second warp threads, 1 ply of the first warp threads, 3 plies of the second warp threads, 1 ply of the warp threads, and 1 ply of the second warp threads are arranged, 400 plies of the warp threads WP, which include 29 plies of the first darker khaki warp threads, 57 plies of the second dark khaki warp threads, 57 plies of the third khaki warp threads, 57 plies of the fourth light khaki warp threads, 57 plies of the fifth light green warp threads, 57 plies of the sixth dark beige warp threads, 57 plies of the seventh brown warp threads, and 29 plies of the eighth dark brown warp threads, form one color cycle, the warp threads are repeatedly arranged with the colors cycle, the repeatedly arranged warp threads WP are wound onto the warp beam and the warp beam is mounted at the jacquard weaving machine, and the weft threads include first dark darker khaki weft threads, second dark khaki weft threads, third khaki weft threads, fourth light khaki weft threads, fifth light green weft threads, sixth dark beige weft threads, seventh brown weft threads, and eighth dark beige weft threads, one color arrangement cycle of the weft threads WT is 448 plies, 8 plies of the first darker khaki weft threads, 1 ply of the second dark khaki weft threads, 3 plies of the first weft threads, 1 ply of the second weft threads, and 2 plies of the first weft threads are arranged, 1 ply of the second weft threads and 1 ply of the first weft threads are repeatedly arranged five times, 2 plies of the second weft threads, 1 ply of the first weft threads, 3 plies of the second weft threads, 1 ply of the weft threads, and 8 plies of the second weft threads are arranged, 1 ply of the third khaki weft threads, 3 plies of the second weft threads, 1 ply of the third weft threads, and 2 plies of the second weft threads WT are arranged, 1 ply of the third weft threads and 1 ply of the second weft threads are repeatedly arranged five times, 2 plies of the third weft threads, 1 ply of the second weft threads, 3 plies of the third weft threads, 1 ply of the second weft threads, and 8 plies of the weft threads are arranged, 1 ply of the fourth light khaki weft threads, 3 plies of the third weft threads, 1 ply of the fourth weft threads, and 2 plies of the weft threads are arranged, 1 ply of the fourth weft threads and 1 ply of the third weft threads are repeatedly arranged five times, 2 plies of the fourth weft threads, 1 ply of the third weft threads, 3 plies of the fourth weft threads, 1 ply of the third weft threads, and 8 plies of the fourth weft threads are arranged, 1 ply of the fifth light green weft threads, 3 plies of the fourth weft threads, 1 ply of the fifth weft threads, and 2 plies of the fourth weft threads are arranged, 1 ply of the fifth weft threads and 1 ply of the fourth weft threads are repeatedly arranged five times, 2 plies of the fifth weft threads, 1 ply of the fourth weft threads, 3 plies of the fifth weft threads, 1 ply of the fourth weft threads, and 8 plies of the fifth weft threads are arranged, 1 ply of the sixth dark beige weft threads, 3 plies of the fifth weft threads, 1 ply of the sixth weft threads, and 2 plies of the fifth weft threads are arranged, 1 ply of the sixth weft threads and 1 ply of the fifth weft threads are repeatedly arranged five times, 2 plies of the sixth weft threads, 1 ply of the fifth weft threads, 3 plies of the sixth weft threads, 1 ply of the fifth weft threads, and 8 plies of the sixth weft threads are arranged, 1 ply of the seventh brown weft threads, 3 plies of the sixth weft threads, 1 ply of the seventh weft threads, and 2 plies of the sixth weft threads are arranged, 1 ply of the seventh weft threads and 1 ply of the sixth weft threads are repeatedly arranged five times, 2 plies of the seventh weft threads, 1 ply of the sixth weft threads, 3 plies of the seventh weft threads, 1 ply of the sixth weft threads, and 8 plies of the seventh weft threads are arranged, 1 ply of the eighth dark brown weft threads, 3 plies of the seventh weft threads, 1 ply of the eighth weft threads, and 2 plies of the seventh weft threads are arranged, 1 ply of the eighth weft threads and 1 ply of the seventh weft threads are repeatedly arranged five times, 2 plies of the eighth weft threads, 1 ply of the seventh weft threads, 3 plies of eighth weft threads, 1 ply of the seventh weft threads, and 8 plies of the eighth weft threads are arranged, 1 ply of the seventh weft threads, 3 plies of the eight weft threads, 1 ply of the seventh weft threads, and 2 plies of the eighth weft threads are arranged, 1 ply of the seventh weft threads and 1 ply of the eighth weft threads are repeatedly arranged five times, 2 plies of the seventh weft threads, 1 ply of the eighth weft threads, 3 plies of the seventh weft threads, 1 ply of the eighth weft threads, and 8 plies of the seventh weft threads are arranged, 1 ply of the sixth weft threads, 3 plies of the seventh weft threads, 1 ply of the sixth weft threads, and 2 plies of the seventh weft threads are arranged, 1 ply of the sixth weft threads and 1 ply of the seventh weft threads are repeatedly arranged five times, 2 plies of the sixth weft threads, 1 ply of the seventh weft threads, 3 plies of the sixth weft threads, 1 ply of the seventh weft threads, and 8 plies of the sixth weft threads are arranged, 1 ply of the fifth weft threads, 3 plies of the sixth weft threads, 1 ply of the fifth weft threads, and 2 plies of the sixth weft threads are arranged, 1 ply of the fifth weft threads and 1 ply of the sixth weft threads are repeatedly arranged five times, 2 plies of the fifth weft threads, 1 ply of the sixth weft threads, 3 plies of the fifth weft threads, 1 ply of the sixth weft threads, and 8 plies of the fifth weft threads are arranged, 1 ply of the fourth weft threads, 3 plies of the fifth weft threads, 1 ply of the fourth weft threads, and 2 plies of the fifth weft threads are arranged, 1 ply of the fourth weft threads and 1 ply of the fifth weft threads are repeatedly arranged five times, 2 plies of the fourth weft threads, 1 ply of the fifth weft threads, 3 plies of the fourth weft threads, 1 ply of the fifth weft threads, and 8 plies of the fourth weft threads are arranged, 1 ply of the third weft threads, 3 plies of the fourth weft threads, 1 ply of the third weft threads, and 2 plies of the fourth weft threads are arranged, 1 ply of the third weft threads and 1 ply of the fourth weft threads are repeatedly arranged five times, 2 plies of the third weft threads, 1 ply of the fourth weft threads, 3 plies of the third weft threads, 1 ply of the fourth weft threads, and 8 plies of the fifth weft threads are arranged, 1 ply of the second weft threads, 3 plies of the third weft threads, 1 ply of the second weft threads, and 2 plies of the weft threads are arranged, 1 ply of the second weft threads and 1 ply of the third weft threads are repeatedly arranged five times, 2 plies of the second weft threads, 1 ply of the third weft threads, 3 plies of the second weft threads, 1 ply of the third weft threads, and 8 plies of the second weft threads are arranged, 1 ply of the first weft threads, 3 plies of the second weft threads, 1 ply of the first weft threads, and 2 plies of the second weft threads are arranged, 1 ply of the first weft threads and 1 ply of the second weft threads are repeatedly arranged five times, 2 plies of the first weft threads, 1 ply the second weft threads, 3 plies of the first weft threads, and 1 ply of the second weft threads are arranged, 448 plies of the weft threads, which include 32 plies of the first darker khaki weft threads, 64 plies of the second dark khaki weft threads, 64 plies of the third khaki weft threads, 64 plies of the fourth light khaki weft threads, 64 plies of the fifth light green weft threads, 64 plies of the sixth dark beige weft threads, 64 plies of the seventh brown weft threads, and 32 plies of the eighth dark brown weft threads, form one cycle, the weft threads of the cycle are inserted between the opened weft threads WT in arranged order, the cycle is repeated to weave the camouflage clothing, the camouflage clothing includes an alternate pattern woven by 1/1 plain weave, a first pattern 30 woven by 3/1 warp twill weave, and a second pattern woven by 1/3 weft twill weave.

* * * * *